US011559879B2

(12) United States Patent
Machida

(10) Patent No.: US 11,559,879 B2
(45) Date of Patent: Jan. 24, 2023

(54) POWER TOOL

(71) Applicant: MAKITA CORPORATION, Anjo (JP)

(72) Inventor: Yoshitaka Machida, Anjo (JP)

(73) Assignee: MAKITA CORPORATION, Anjo (JP)

( * ) Notice: Subject to any disclaimer, the term of this patent is extended or adjusted under 35 U.S.C. 154(b) by 387 days.

(21) Appl. No.: 16/797,120

(22) Filed: Feb. 21, 2020

(65) Prior Publication Data

US 2020/0316766 A1 Oct. 8, 2020

(30) Foreign Application Priority Data

Apr. 5, 2019 (JP) ..... JP2019-073006

(51) Int. Cl.
*B25F 5/02* (2006.01)
*A45F 5/00* (2006.01)
*B25H 3/00* (2006.01)

(52) U.S. Cl.
CPC ..... *B25F 5/02* (2013.01); *A45F 5/00* (2013.01); *B25H 3/006* (2013.01); *A45F 2200/0575* (2013.01)

(58) Field of Classification Search
CPC ..... B25F 5/02; A45F 5/00; A45F 2200/0575; B25H 3/006
See application file for complete search history.

(56) References Cited

U.S. PATENT DOCUMENTS 777,996 A * 12/1904 Applegate ..... F16M 11/14 248/240.4
4,106,679 A * 8/1978 Hillinger ..... B25H 3/00 224/197
4,558,495 A * 12/1985 Olsen ..... B25B 33/005 24/298
4,787,145 A * 11/1988 Klicker ..... B27B 9/00 30/388
5,272,813 A * 12/1993 Wolf ..... B27B 17/0008 30/296.1
5,332,071 A * 7/1994 Duncan ..... E04G 21/3295 267/74
5,850,698 A * 12/1998 Hum ..... B27B 9/00 30/377
5,992,716 A * 11/1999 Riley ..... G01C 9/26 224/904

(Continued)

FOREIGN PATENT DOCUMENTS

JP 2011-235372 A 11/2011
WO WO-2004048046 A1 * 6/2004 ..... B25F 5/00
WO WO-2019194036 A1 * 10/2019 ..... B24B 23/02

OTHER PUBLICATIONS

Oct. 4, 2022 Office Action issued in Japanese Patent Application No. 2019-073006.

*Primary Examiner* — Stanton L Krycinski
(74) *Attorney, Agent, or Firm* — Oliff PLC

(57) ABSTRACT

A power tool can absorb the shock from suspension resulting from falling while preventing the power tool from falling on the ground. A power tool includes a tool holder attachable to the power tool. The tool holder includes an annular portion that receives a suspension member through the annular portion, a base supporting the annular portion, and at least one bend located between the annular portion and the base.

20 Claims, 24 Drawing Sheets

(56) References Cited

U.S. PATENT DOCUMENTS 6,679,406 B2 * 1/2004 Sakai ..... B25B 23/045 224/904
6,722,549 B2 * 4/2004 Shkolnikov ..... B25C 1/08 248/680
6,776,317 B1 * 8/2004 Parker ..... A45F 5/00 224/904
6,835,032 B1 * 12/2004 Pozgay ..... B25G 3/18 409/181
7,111,364 B2 * 9/2006 Bader ..... B25H 3/006 224/268
7,306,052 B2 * 12/2007 Vahabi-Nejad ..... B25C 7/00 173/217
7,458,135 B2 * 12/2008 Mikesell ..... B25H 3/006 24/301
7,681,661 B2 * 3/2010 Sakai ..... B25F 5/029 173/217
8,087,556 B2 * 1/2012 Oomori ..... B25C 7/00 224/904
8,167,056 B2 * 5/2012 Ito ..... B25H 3/006 173/171
8,308,034 B2 * 11/2012 Shibata ..... B25F 5/02 224/904
D676,311 S * 2/2013 Moreau ..... D8/356
8,403,132 B2 * 3/2013 Moreau ..... A45F 5/021 224/904
D679,577 S * 4/2013 Moreau ..... D8/367
8,443,913 B2 * 5/2013 Nagasaka ..... B25F 5/02 173/171
8,534,375 B2 * 9/2013 Matsumoto ..... B25F 5/02 173/171
8,567,290 B2 * 10/2013 Moreau ..... B25B 15/02 81/184
8,573,322 B2 * 11/2013 Nagasaka ..... B25F 5/02 173/171
8,661,694 B2 * 3/2014 Bijsterveldt ..... B25F 5/02 30/298.4
8,752,744 B2 * 6/2014 Okouchi ..... B25F 5/02 248/692
8,919,629 B2 * 12/2014 Moreau ..... A45F 5/02 206/37.1
8,997,317 B2 * 4/2015 Rinklake ..... A62B 35/04 24/301
9,016,397 B2 * 4/2015 Kuroyanagi ..... B25F 5/02 173/171
9,232,850 B2 * 1/2016 Moreau ..... A45F 5/02
9,254,032 B2 * 2/2016 Moreau ..... A45F 5/00
9,457,461 B2 * 10/2016 Francis ..... B25F 5/02
9,522,464 B2 * 12/2016 Segura ..... F16M 13/022
D775,517 S * 1/2017 Votel ..... D8/382
9,833,893 B2 * 12/2017 Moreau ..... A45C 13/30
10,045,606 B2 * 8/2018 Cirincione, II ..... A45F 5/00
10,058,986 B1 * 8/2018 Hu ..... A45F 5/021
10,286,539 B2 * 5/2019 Francis ..... A61P 43/00
10,576,616 B2 * 3/2020 Hays ..... B25H 3/006
10,759,080 B2 * 9/2020 Masatoshi ..... B25F 5/02
10,814,469 B2 * 10/2020 Schulz ..... B25F 5/02
10,888,989 B2 * 1/2021 Kawakami ..... H01M 50/20
11,205,820 B2 * 12/2021 Hanawa ..... H01M 50/296
11,338,427 B2 * 5/2022 Nick ..... B25F 5/001
11,433,525 B2 * 9/2022 Niwa ..... B25F 5/00
2003/0102342 A1 * 6/2003 Fogg ..... B25H 3/006 224/259
2004/0050888 A1 * 3/2004 Warner ..... A45F 5/00 224/269
2005/0015935 A1 * 1/2005 Bader ..... B25F 5/02 16/430
2006/0065684 A1 * 3/2006 Houcek ..... F16L 3/133 224/269
2006/0070761 A1 * 4/2006 Vahabi-Nejad ..... B25C 7/00 173/171
2007/0138227 A1 * 6/2007 Rickman ..... B25H 3/006 224/678
2007/0228093 A1 * 10/2007 Durham ..... B25H 3/006 224/248
2008/0163464 A1 * 7/2008 Baumann ..... A45F 5/02 24/3.12
2008/0169396 A1 * 7/2008 Heen ..... A45F 5/02 248/309.1
2009/0278012 A1 * 11/2009 Okouchi ..... B25F 5/02 248/304
2010/0147912 A1 * 6/2010 Salentine ..... A45F 5/02 224/254
2011/0139479 A1 * 6/2011 Nagasaka ..... B25F 5/02 173/217
2011/0289786 A1 * 12/2011 Bijsterveldt ..... B25F 5/02 30/514
2012/0085560 A1 * 4/2012 Kuroyanagi ..... B25F 5/02 248/692
2012/0168472 A1 * 7/2012 Mathews ..... A45F 5/021 224/162
2012/0267403 A1 * 10/2012 Ward, Jr. ..... A45F 5/00 224/219
2013/0062498 A1 * 3/2013 Ito ..... B25B 21/00 248/672
2013/0180368 A1 * 7/2013 Kumagai ..... B25D 17/08 81/185.2
2014/0091648 A1 * 4/2014 Kumagai ..... H02K 7/145 310/50
2014/0097217 A1 * 4/2014 Walsh ..... A45F 5/02 224/268
2014/0298664 A1 * 10/2014 Van Bijsterveldt ..... B27B 17/0008 30/298.4
2015/0266201 A1 * 9/2015 Nakashima ..... B27B 5/29 30/374
2016/0227911 A1 * 8/2016 Benzakin ..... A45F 5/00
2016/0257065 A1 * 9/2016 Moreau ..... B25H 3/00
2016/0375575 A1 * 12/2016 Moreau ..... A45F 5/021 29/401.1
2017/0119137 A1 5/2017 Cirincione, II et al.
2017/0259422 A1 * 9/2017 Takeyama ..... B25H 3/003
2020/0194747 A1 * 6/2020 Rudolph ..... H02J 7/0026
2021/0001418 A1 * 1/2021 Nakashima ..... B23D 47/00
2021/0053175 A1 * 2/2021 Otani ..... B25F 5/02
2021/0107130 A1 * 4/2021 Yoshikane ..... B25H 3/006
2021/0205977 A1 * 7/2021 Machida ..... B25F 5/02
2022/0221834 A1 * 7/2022 Dobashi ..... B25F 5/02

* cited by examiner

POWER TOOL

CROSS-REFERENCE TO RELATED APPLICATIONS

This application claims the benefit of priority to Japanese Patent Application No. 2019-073006, filed on Apr. 5, 2019, the entire contents of which are hereby incorporated by reference.

BACKGROUND

1. Technical Field

The present invention relates to a power tool including a tool holder.

2. Description of the Background

Various measures have been taken to prevent a power tool from falling during work at an elevated site. U.S. Patent Application Publication No. 2017/0119137 (hereafter, Patent Literature 1) describes a strap 1202 serving as a tool holder in FIG. 24 cited from Patent Literature 1. The strap 1202 includes a tension spring 1240 and is attachable in a loop shape to a housing (not shown) of a hand-held power tool (of a grinder body not shown). After a suspension member (not shown) such as a cord passes through an annular portion of the strap 1202 attached to the power tool, the basal end of the suspension member can be tied to a handrail or scaffold at an elevated working site. More specifically, the strap 1202 attached to the power tool can be tethered to a handrail or scaffold at an elevated working site with a suspension member (a carabiner and a cord). When, for example, a manually held power tool is dropped accidentally, the power tool is suspended from the handrail or scaffold at the elevated working site with the suspension member. The suspension member thus causes the tension spring 1240 to stretch (allows the tension spring 1240 to apply its spring force) and absorb shock from suspension from falling. This structure can absorb the shock from suspension resulting from falling while preventing the power tool from falling on the ground.

BRIEF SUMMARY

The suspension member according to the technology of Patent Literature 1 is freely movable in the loop of the strap 1202. Thus, the suspension member may become caught on couplers a that couple a pair of holders 1230 and a tension spring 1240 when the dropped power tool is suspended from a handrail or scaffold at an elevated working site with the suspension member. In this case, the suspension member may prevent the tension spring 1240 from stretching and may not reliably absorb shock from suspension from falling.

One or more aspects of the present invention are directed to a power tool including a tool holder capable of holding an accidentally dropped power tool in suspension with a suspension member while reliably absorbing shock.

An aspect of the present invention provides a power tool, including:

a tool holder attachable to the power tool, the tool holder including an annular portion configured to receive a suspension member through the annular portion, a base supporting the annular portion, and at least one bend located between the annular portion and the base.

DETAILED DESCRIPTION

Figure 1:
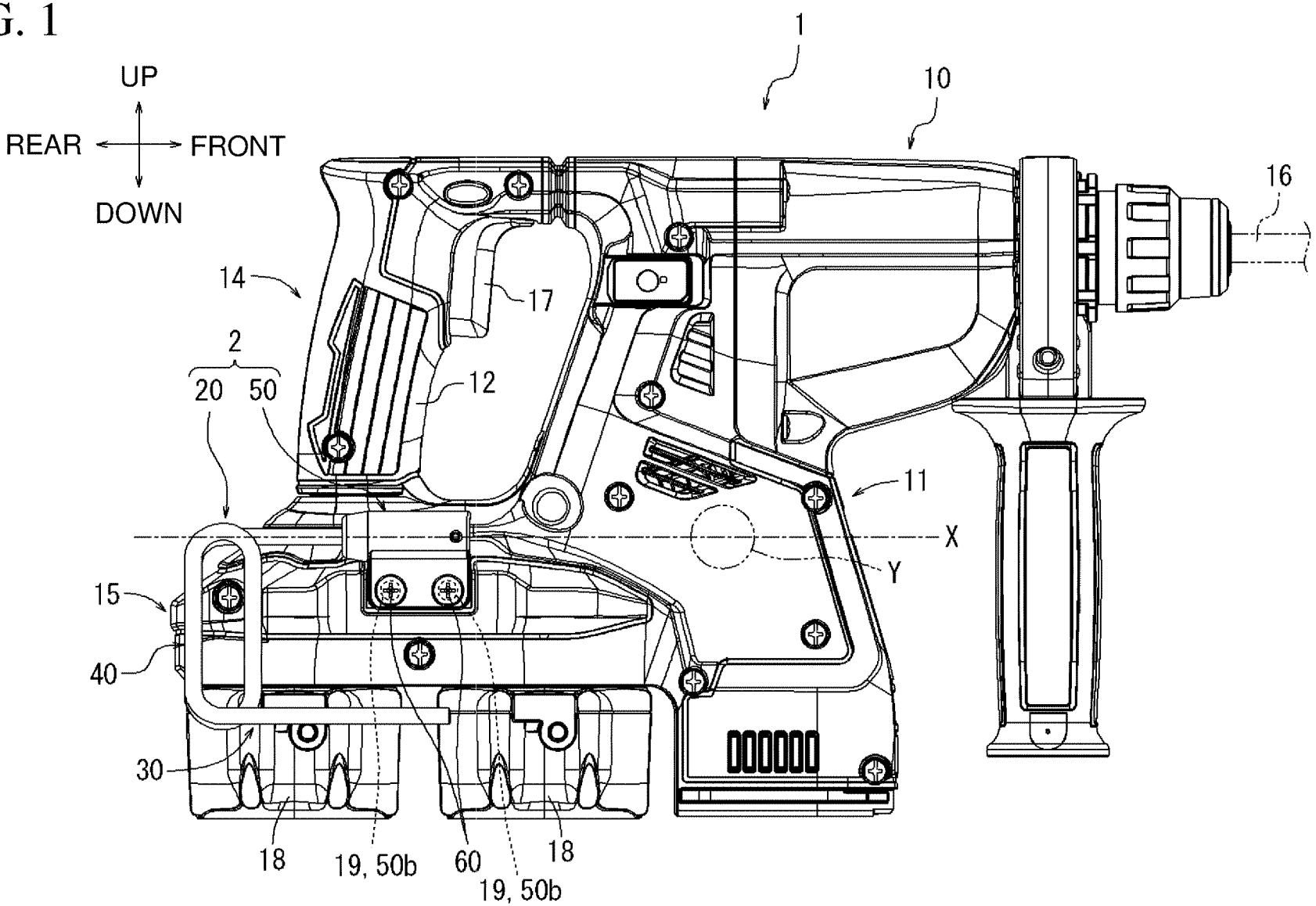
FIG. 1 is a right view of a power tool according to a first embodiment with a holder body retracted.

Embodiments of the present invention will now be described with reference to the drawings.

First Embodiment

A first embodiment will now be described with reference to FIGS. 1 to 11. A hand-held hammer drill will be described below as an example of a power tool 1. Hereafter, up, down, front, rear, left, and right refer to upward, downward, frontward, rearward, leftward, and rightward directions in the drawings described above. More specifically, the frontward direction refers to the direction toward the distal end of the power tool 1 (direction in which a drill bit 16 extends). The same applies to all the embodiments described below.

A power tool 1 and a tool holder 2 attached to a right portion of a battery mount 15 of the power tool 1 will first be described separately.

Figure 2:
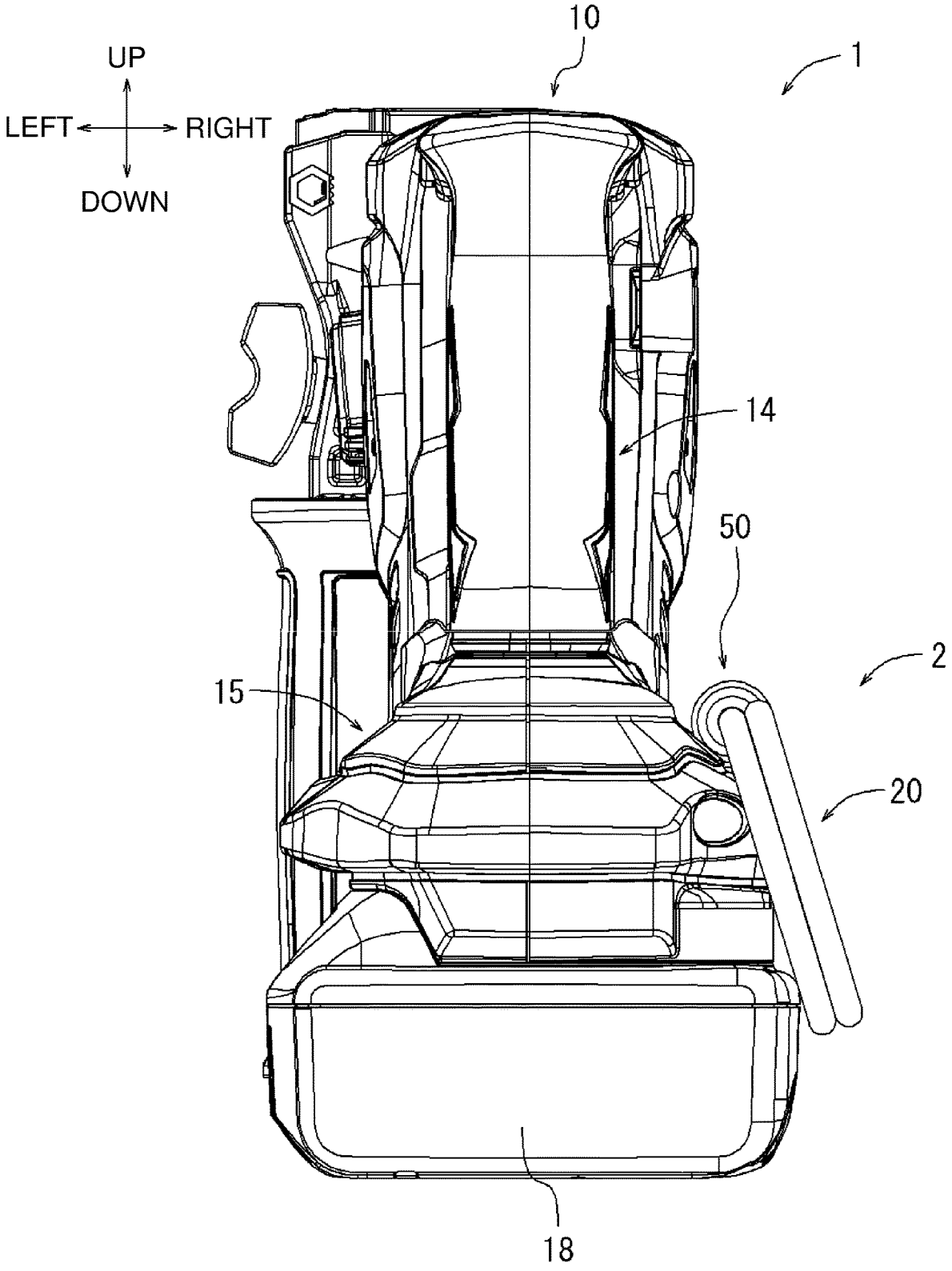
FIG. 2 is a rear view of the power tool in FIG. 1.
Figure 3:
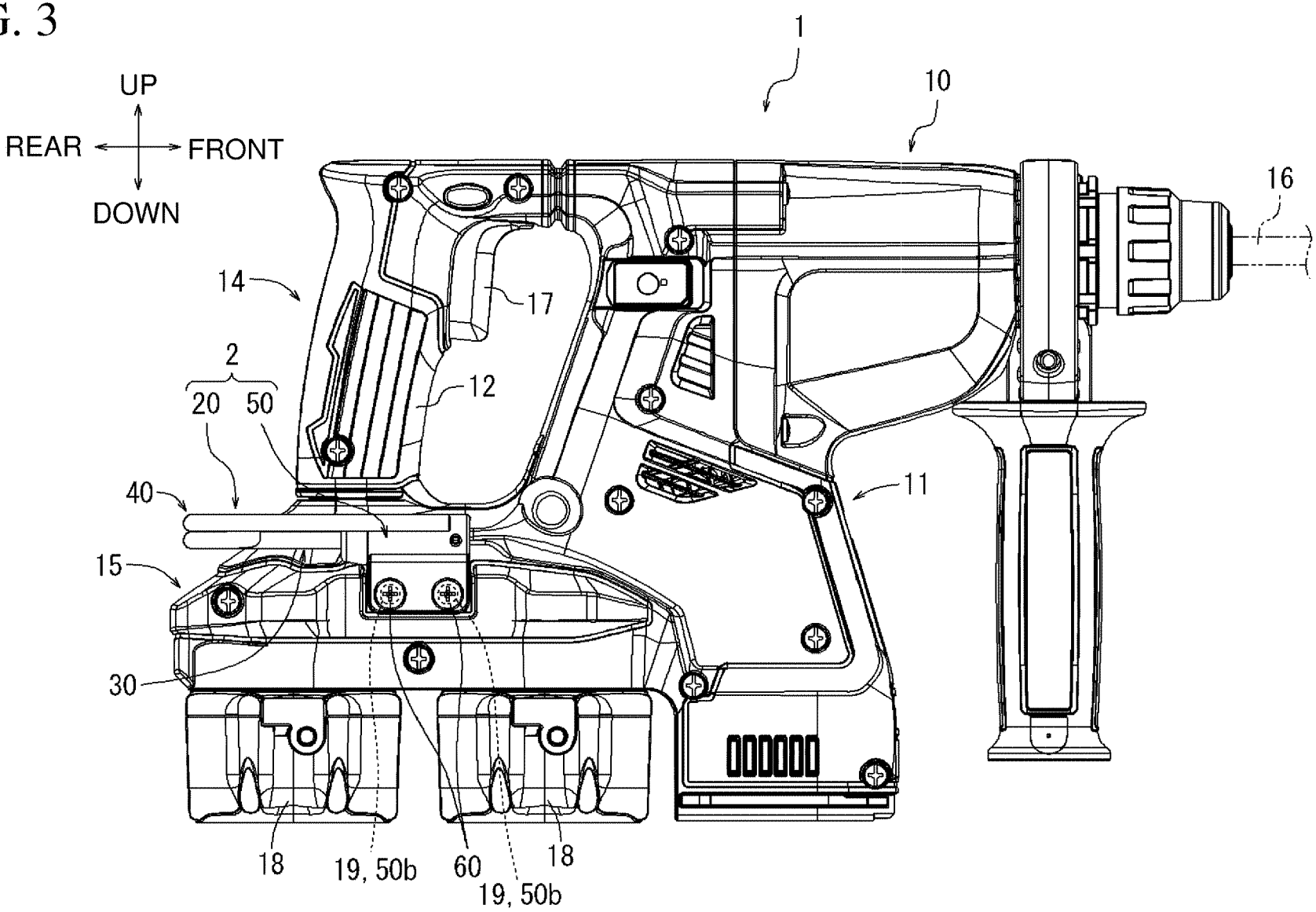
FIG. 3 is a view of the power tool in FIG. 1 with the holder body pulled out.
Figure 4:
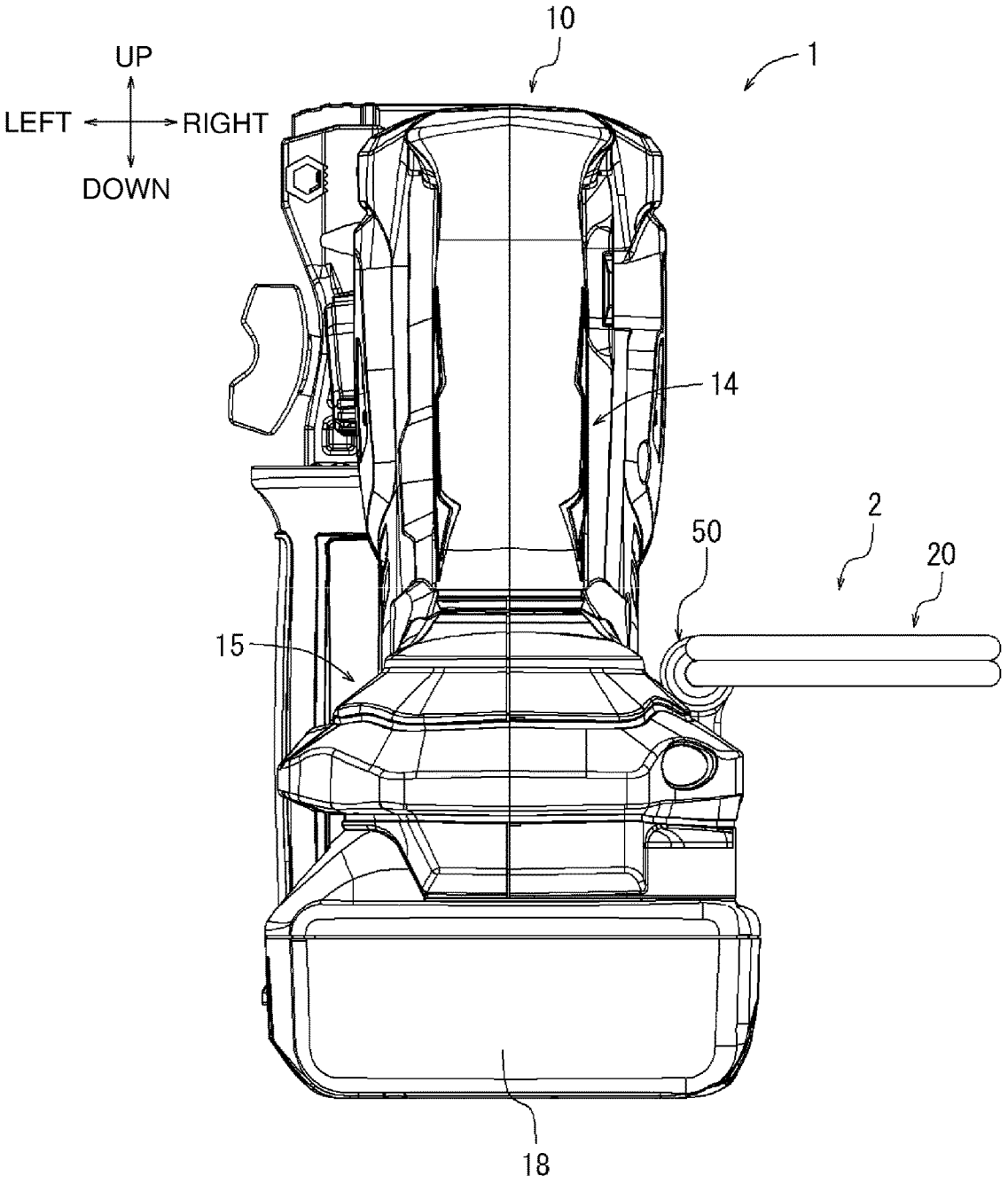
FIG. 4 is a rear view of the power tool in FIG. 3.

The power tool 1 will be described now (refer to FIGS. 1 and 2). The power tool 1 mainly includes a body housing 10, a motor housing 11, a hand grip 14, and a battery mount 15. The body housing 10 defines an outer wall of the power tool 1. The motor housing 11 is attached to a lower portion of the body housing 10. The hand grip 14 is attached to the rear to extend between the body housing 10 and the motor housing 11. The battery mount 15 is attached to a lower portion to extend between the motor housing 11 and the hand grip 14.

The body housing 10 incorporates a striking mechanism (not shown) and a rotation mechanism (not shown). The striking mechanism converts a rotational force of an output shaft (not shown) of a motor (not shown) to axial striking force on a drill bit 16. The rotation mechanism converts the rotational force of the motor output shaft to a rotational force on the drill bit about the axis. The motor housing 11 incorporates a motor (not shown) with an output shaft (not shown) oriented upward.

The hand grip 14 has a handle 12 gripped by an operator. A trigger 17 is attached to the hand grip 14. When an operator pulls the trigger 17, an internal switch (not shown) is turned on.

Two battery packs 18, serving as power sources, are mounted on the battery mount 15 to align in the front-rear direction. The battery mount 15 has two screw holes 19 for attachment of the tool holder 2 (described later).

When the operator pulls the trigger 17 while gripping the handle 12 of the hand grip 14, the pull activates the internal switch to input an electric signal to a controller (not shown) incorporated in the motor housing 11. Thus, the motor output shaft is rotated. The rotational force of the motor output shaft is converted to axial striking force and is transmitted to the drill bit 16 through the striking mechanism. Thus, the drill bit 16 can perform a striking operation.

Together with the striking operation, the rotational force of the motor output shaft is converted to a rotational force about the axis, and is transmitted to the drill bit 16 through the rotation mechanism. Thus, the drill bit 16 can perform a rotational operation. The striking force and the rotational force can thus be provided to the drill bit 16 to allow the drill bit 16 to efficiently perform operations such as boring on gypsum or breaking of a concrete block.

The tool holder 2 will now be described. As shown in FIGS. 5 to 8, the tool holder 2 includes a holder body 20, a base 50, and a shock-absorbing mechanism 25. The holder body 20 is substantially U-shaped. The base 50 rotatably supports the holder body 20. The shock-absorbing mechanism 25 is placed between the holder body 20 and the base 50 to absorb shock by allowing relative movement between the holder body 20 and the base 50.

The holder body 20 is formed by bending a single wire (metal wire). The holder body 20 includes a hook portion 30 and an annular portion 40. The hook portion 30 includes a shaft 31, an intermediate portion 32, and a distal end 33. The hook portion 30 is substantially U-shaped. The annular portion 40 includes an overlapping portion 41, an opposing portion 42, a second bend 43, and a third bend 44. The overlapping portion 41 and the opposing portion 42 are straight. The second and third bends 43 and 44 are semicircular to connect the overlapping portion 41 and the opposing portion 42. The shaft 31 is a straight portion including a first end (basal end 31*b*) of the wire. The shaft 31 has, at the first end, an insertion hole 31*a*, which can receive a first spring pin 24 (described later).

The intermediate portion 32 is a straight portion formed by bending a second end (distal end) of the shaft 31 about 90°. The portion bent about 90° is referred to as a first bend 70. In other words, the first bend 70 is located between the shaft 31 and the intermediate portion 32. The opposing portion 42 of the annular portion 40 is a straight portion formed by bending a second end (distal end) of the intermediate portion 32 about 180°. The second bend 43 is a substantially semicircular portion bent about 180° to form the opposing portion 42.

The overlapping portion 41 is a straight portion formed by bending the distal end of the opposing portion 42 about 180° to overlap the intermediate portion 32. The third bend 44 is a substantially semicircular portion bent about 180° to form the overlapping portion 41. The second and third bends 43 and 44 are opposed to each other to form a pair. The distal end 33 is a straight portion including a second end (distal end) of the wire. The distal end 33 is formed by bending the second end (distal end) of the overlapping portion 41 about 90°.

The portion bent about 90° is referred to as a fourth bend 71. In other words, a fourth bend 71 is located between the overlapping portion 41 and the distal end 33. A radius R1 of the portions bent about 90° and 180° is about twice a diameter D of the wire. More specifically, R1=2D (refer to FIG. 6). The first to fourth bends 70, 43, 44, and 71 are located between the annular portion 40 and the base 50 in the direction in which the wire extends.

The hook portion 30 of the holder body 20 according to the present embodiment functions as a U-shaped hook including the shaft 31, the intermediate portion 32, and the distal end 33. The hook portion 30 can hook the power tool 1 on a hook support 4, such as a handrail or scaffold at a working site (refer to FIGS. 5 and 6).

Figure 5:
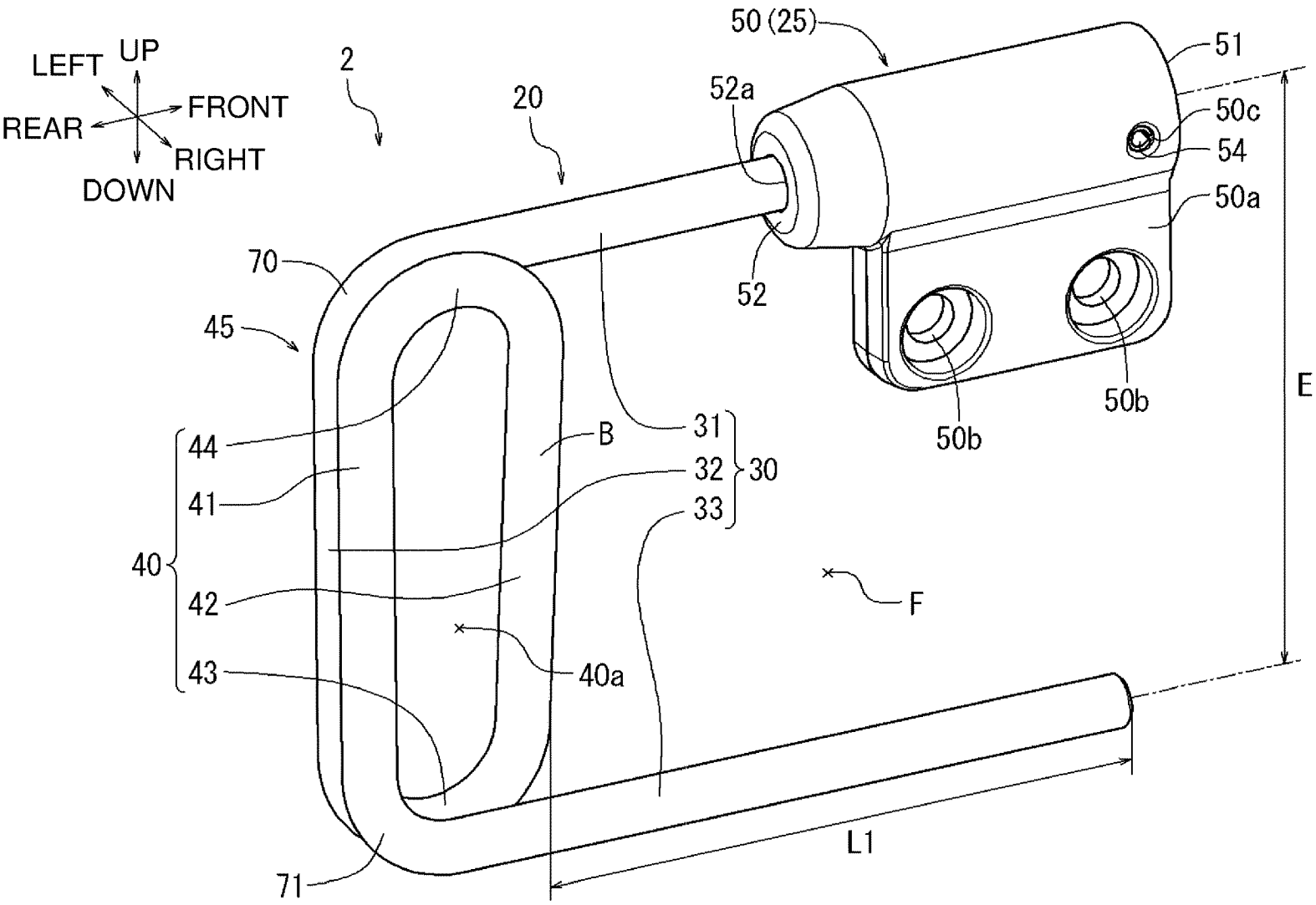
FIG. 5 is an overall perspective view of the tool holder in FIG. 1.
Figure 6:
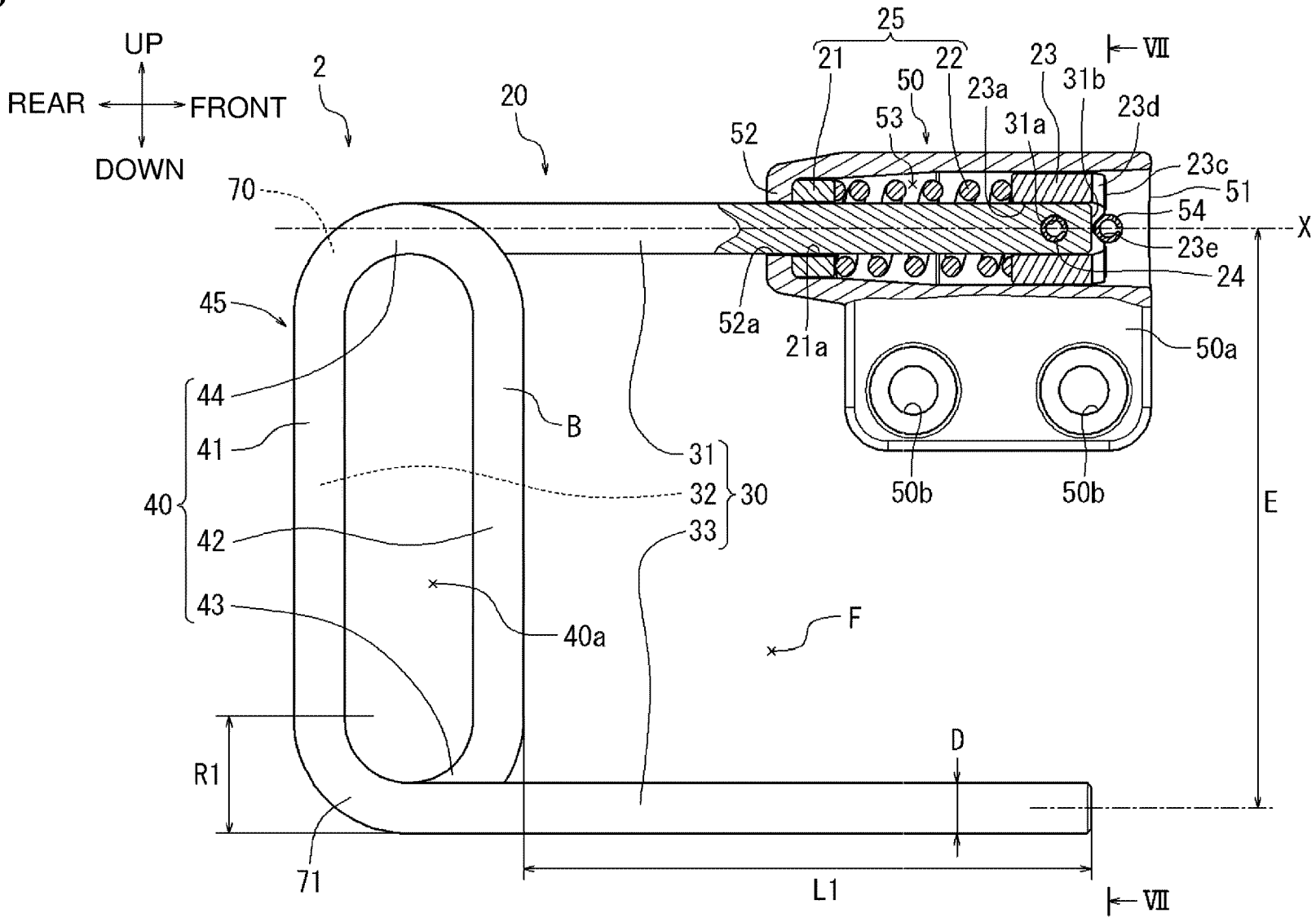
FIG. 6 is a right view of the tool holder in FIG. 5, showing a base in a longitudinal cross section.
Figure 7:
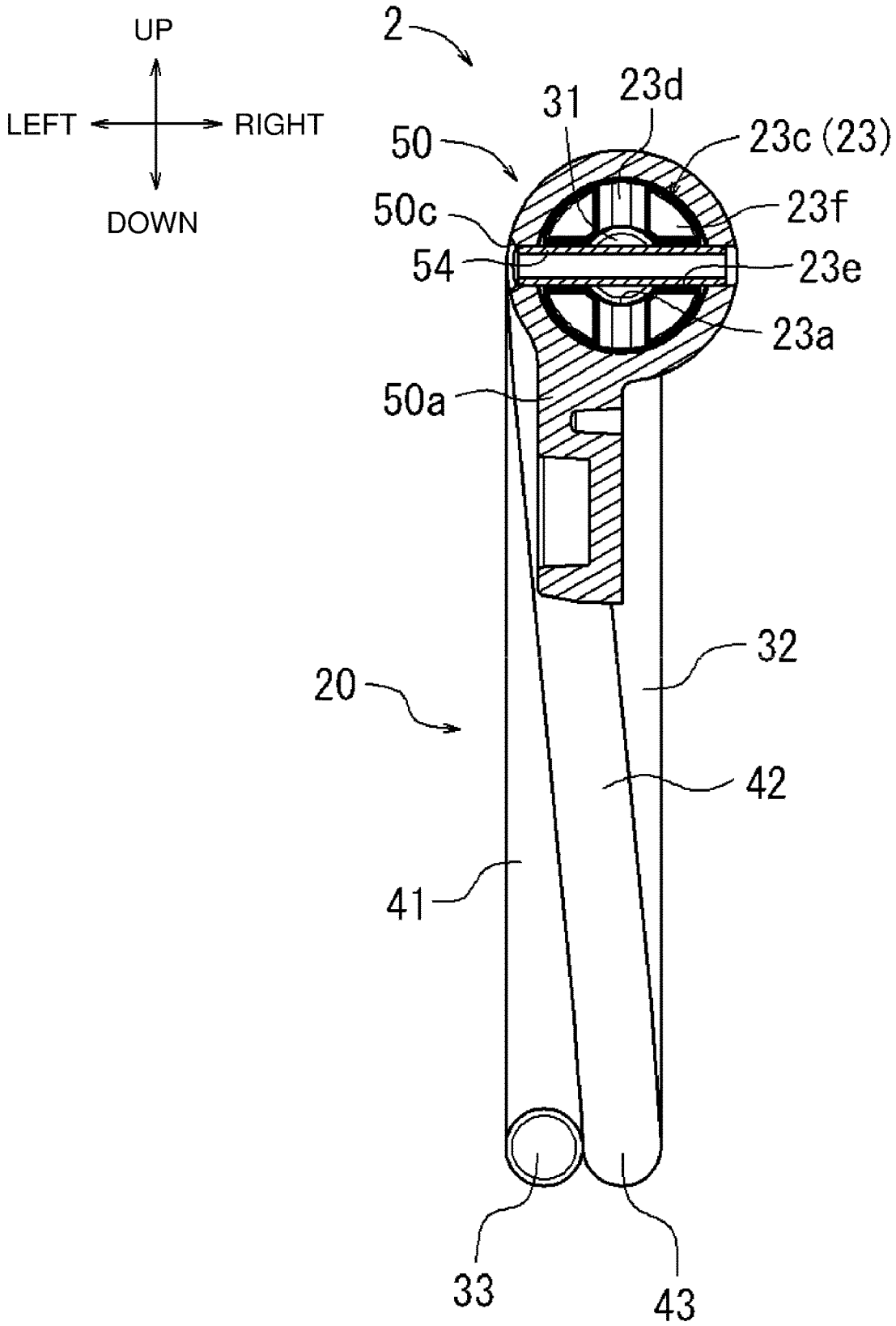
FIG. 7 is a cross-sectional view taken along line VII-VII in FIG. 6.
Figure 8:
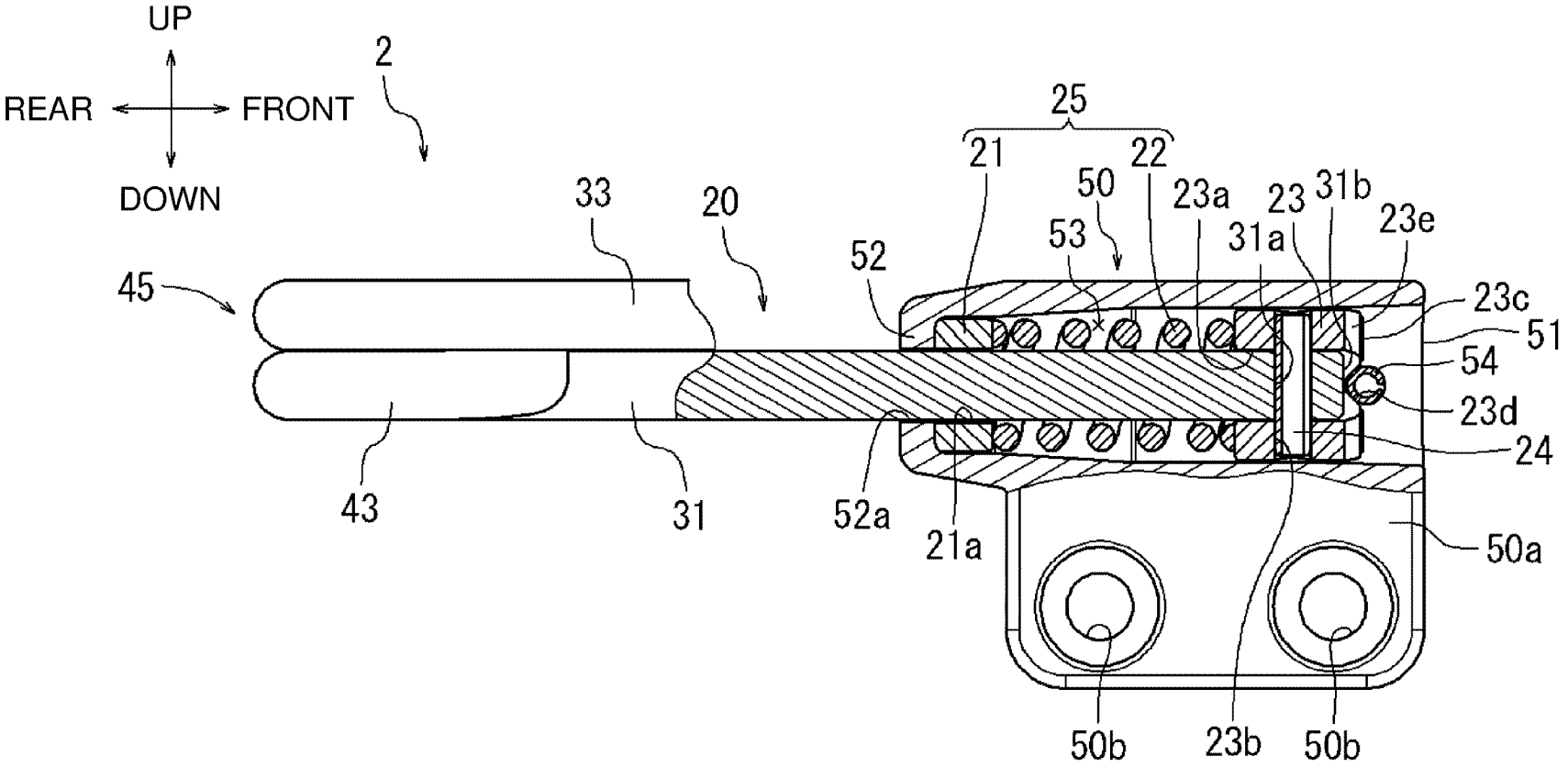
FIG. 8 is a view of the tool holder in FIG. 6 with the holder body pulled out.
Figure 9:
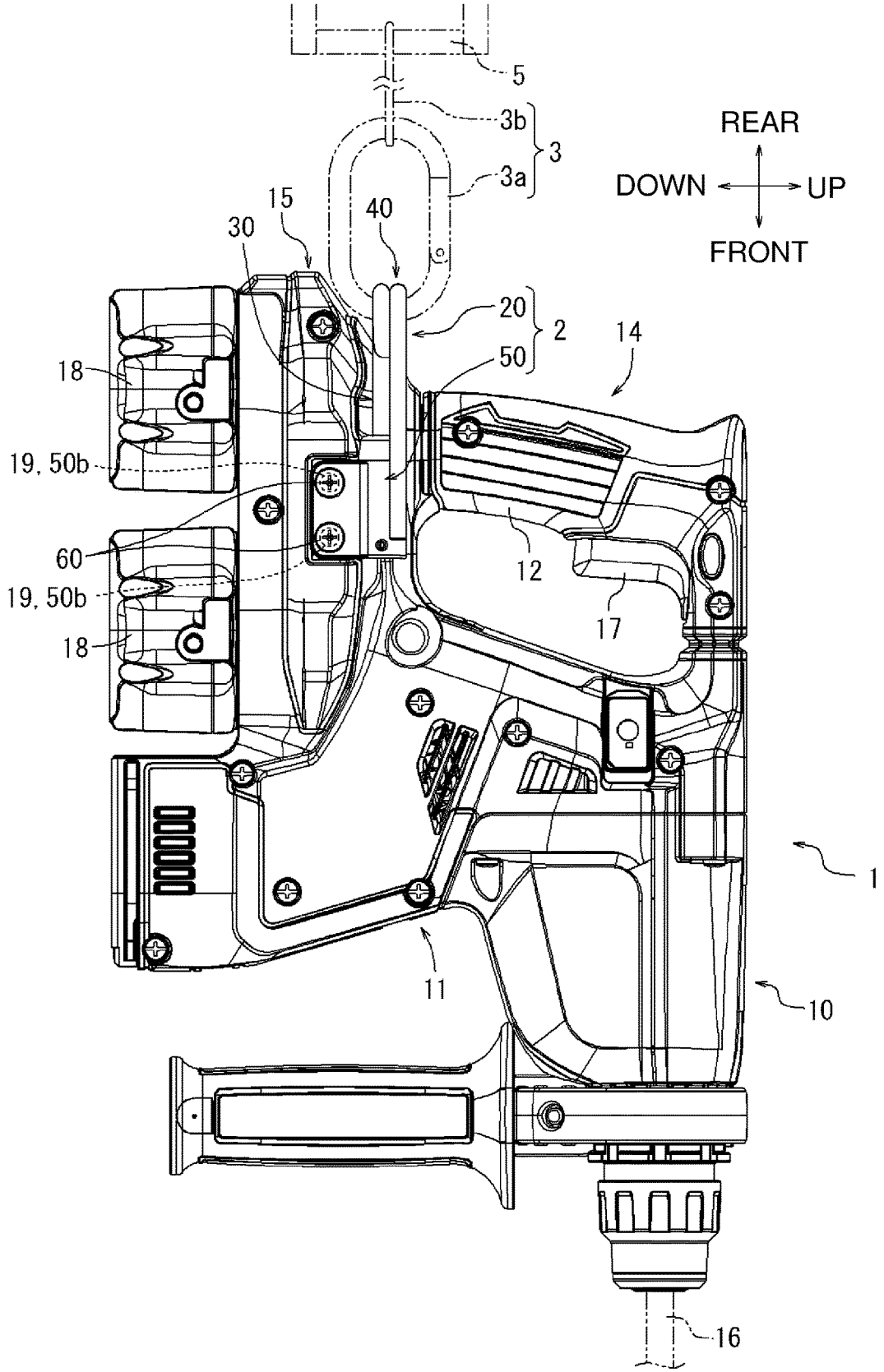
FIG. 9 is a view of the power tool in FIG. 3 suspended with a suspension member.

As shown in FIGS. 5 and 6, a space between the shaft 31 and the distal end 33 functions as an opening E of the hook portion 30, serving as a hook. Through the opening E, the hook support 4 can enter between the shaft 31 and the distal end 33. The hook support 4 entering the opening E comes in contact with a hook bottom B to allow the hook portion 30 to be hooked on the hook support 4. In the first embodiment, the opposing portion 42 of the annular portion 40 corresponds to the hook bottom B. An area between the shaft 31 and the distal end 33 and extending from the opening E to the hook bottom B is defined as a hook area F. While the hook support 4 is in a hooking state of relatively entering the opening E to come in contact with the hook bottom B, the hook support 4 is located in the hook area F.

The annular portion 40 according to the present embodiment includes the overlapping portion 41, the opposing portion 42, and the pair of second and third bends 43 and 44 located in an annular shape to define a through-hole 40*a*. More specifically, the overlapping portion 41 and the opposing portion 42 serve as longer portions, and the pair of second and third bends 43 and 44 serve as shorter portions, forming an ellipse.

In the present embodiment, the intermediate portion 32 and the overlapping portion 41 overlap and form an overlap 45 (double wound portion). As shown in FIGS. 5 and 6, the overlap 45 is located farther from the base 50 of the annular portion 40 (farther from a center of gravity Y of the power tool 1) (refer to FIG. 1).

The annular portion 40 according to the present embodiment is wound inside the hook portion 30. The annular portion 40 extends between the shaft 31 and the distal end 33 of the hook portion 30 to serve as the entire hook bottom B. Thus, the annular portion 40 is elliptical, the hook bottom B has a shock-absorbing function, and the hook portion 30 is highly durable.

The base 50 will now be described. The base 50 is a substantially cylindrical member having an opening 51 at a first end (basal end) and having a second end (distal end) closed with a wall 52. The wall 52 of the base 50 has a through-hole 52*a*, which can receive the shaft 31 of the holder body 20. The base 50 includes a mount flange 50*a* extending laterally. The mount flange 50*a* has two insertion holes 50*b*, each of which can receive a mount screw 60 (described later).

An example procedure for assembling the tool holder 2 including the holder body 20, the base 50, and the shock-absorbing mechanism 25 will now be described. First, an elastic piece 21 and a compression spring 22 are sequentially inserted into an internal space 53 of the base 50 through the opening 51. The elastic piece 21 has a through-hole 21*a*. Subsequently, the shaft 31 is inserted into the through-hole 52*a* in the wall 52 and the through-hole 21*a* in the elastic piece 21, and through the compression spring 22 in this order. Subsequently, the inserted shaft 31 is pushed out of the opening 51. The protruding shaft 31 is then inserted through a first insertion hole 23*a* in a spring stopper 23.

The spring stopper 23 will be described in detail. The spring stopper 23 is a substantially cylindrical member having the first insertion hole 23*a* (refer to FIGS. 6 and 8). The shaft 31 is insertable into the first insertion hole 23*a*. The spring stopper 23 has a second insertion hole 23*b* orthogonal to the first insertion hole 23*a*. The first spring pin 24 (described later) is insertable into the second insertion hole 23*b*. The spring stopper 23 has, on a wall surface of a basal end wall 23*c*, a first notch groove 23*d* and a second notch groove 23*e* orthogonal to each other (refer to FIG. 7). The first notch groove 23*d* vertically extends with substantially V-shaped slopes. The second notch groove 23*e* laterally extends with a substantially V-shaped inclination. Portions of the wall surface of the basal end wall 23*c* without the first notch groove 23*d* and the second notch groove 23*e* are referred to as flat portions 23*f*.

Subsequently, the first spring pin 24 is inserted into the second insertion hole 23*b* in the spring stopper 23 and the insertion hole 31*a* in the shaft 31. Thus, the shaft 31 is coupled to the spring stopper 23. The shaft 31 is then pulled out from the through-hole 52*a* in the base 50 against the urging force from the compression spring 22 until the basal end wall 23*c* of the spring stopper 23 passes beyond a pin insertion hole 50*c* in the base 50 (refer to FIGS. 5 and 7). A second spring pin 54 is then inserted into the pin insertion hole 50*c* in the base 50 while the shaft 31 remains pulled out.

The second spring pin 54 is thus coupled to the base 50. The holder body 20 can be urged against the second spring pin 54 under the urging force from the compression spring 22. Finally, the pulled shaft 31 is released, and the second spring pin 54 is fitted into the second notch groove 23*e* on the spring stopper 23 under the urging force from the compression spring 22. The tool holder 2 is assembled in this manner.

The mount screws 60 are inserted into two insertion holes 50*b* in the mount flange 50*a* of the assembled tool holder 2. The inserted mount screws 60 are screwed on two screw holes 19 in the battery mount 15. Thus, the tool holder 2 is attached to the battery mount 15 though thread engagement. To remove the tool holder 2 attached to the battery mount 15, the two mount screws 60 are to be unscrewed.

More specifically, the base 50 of the tool holder 2 is removably attached to the battery mount 15 of the power tool 1. In the assembled tool holder 2 in FIG. 6, the second spring pin 54 is fitted into the second notch groove 23*e*. Thus, the holder body 20 of the tool holder 2 remains retracted along the side of the power tool 1 (in a retracted state for storage while the power tool 1 is not in use) (refer to FIGS. 1, 2, and 6).

The procedure for switching the holder body 20 from the retracted state to the state of being pulled out to extend laterally (pulled-out state) will now be described. First, the holder body 20 is rotated about an axis X of the shaft 31 with respect to the base 50 from the retracted state (refer to FIGS. 6 and 7). Then, the second spring pin 54 moves over the sloping surface of the second notch groove 23*e* on the spring stopper 23 against the urging force from the compression spring 22 and is placed on the flat portions 23*f*. The holder body 20 is further rotated about the axis X of the shaft 31 with respect to the base 50.

Then, the second spring pin 54 is fitted into the first notch groove 23*d* on the spring stopper 23 in the rotated holder body 20 under the urging force from the compression spring 22. The holder body 20 can thus be held at a position rotated by 90° with respect to the base 50. Thus, the holder body 20 can be switched from the retracted position along the side of the power tool 1 to the state of being pulled out (pulled-out state) (refer to FIGS. 3, 4, and 8). When the holder body 20 is reversely rotated from the pulled-out state about the axis X of the shaft 31 with respect to the base 50, the holder body 20 can return to the retracted state.

The operation of the tool holder 2 according to the present embodiment will now be described. The holder body 20 switched to the pulled-out state allows a carabiner 3*a* attached to the distal end of a cord 3*b* of a suspension member 3 to pass through the through-hole 40*a* in the annular portion 40 switched to the pulled-out state. Thus, the basal end (not shown) of the cord 3*b* with the carabiner 3*a* passing through the through-hole 40*a* can be tied to a suspension support 5 at, for example, an elevated working site (refer to FIG. 9). More specifically, the annular portion 40 of the tool holder 2 attached to the power tool 1 can be tethered to the suspension support 5 at, for example, an elevated working site with the suspension member 3 (the carabiner 3*a* and the cord 3*b*).

If the manually held power tool 1 is dropped accidentally, the dropped power tool 1 is suspended from the suspension support 5 at, for example, an elevated working site with the suspension member 3. Thus, the accidentally dropped power tool 1 is prevented from falling on the ground (not shown). The tool holder 2 can thus prevent the power tool 1 from falling during work at an elevated site.

If the manually held power tool 1 is dropped accidentally, the carabiner 3*a* consistently moves to the position farthest from the base 50 (farthest from the center of gravity Y of the power tool 1) inside the through-hole 40*a*. Upon completion of the movement, the annular portion 40 receives shock from the carabiner 3*a* suspended from falling. More specifically, a point of shock application S of the annular portion 40 to receive shock from the carabiner 3*a* shifts to a position farthest from the base 50 (farthest from the center of gravity Y of the power tool 1) inside the through-hole 40*a*. Thus, the shock applied on the annular portion 40 efficiently deforms the bend (mainly, the first bend 70) of the holder body 20.

Figure 10:
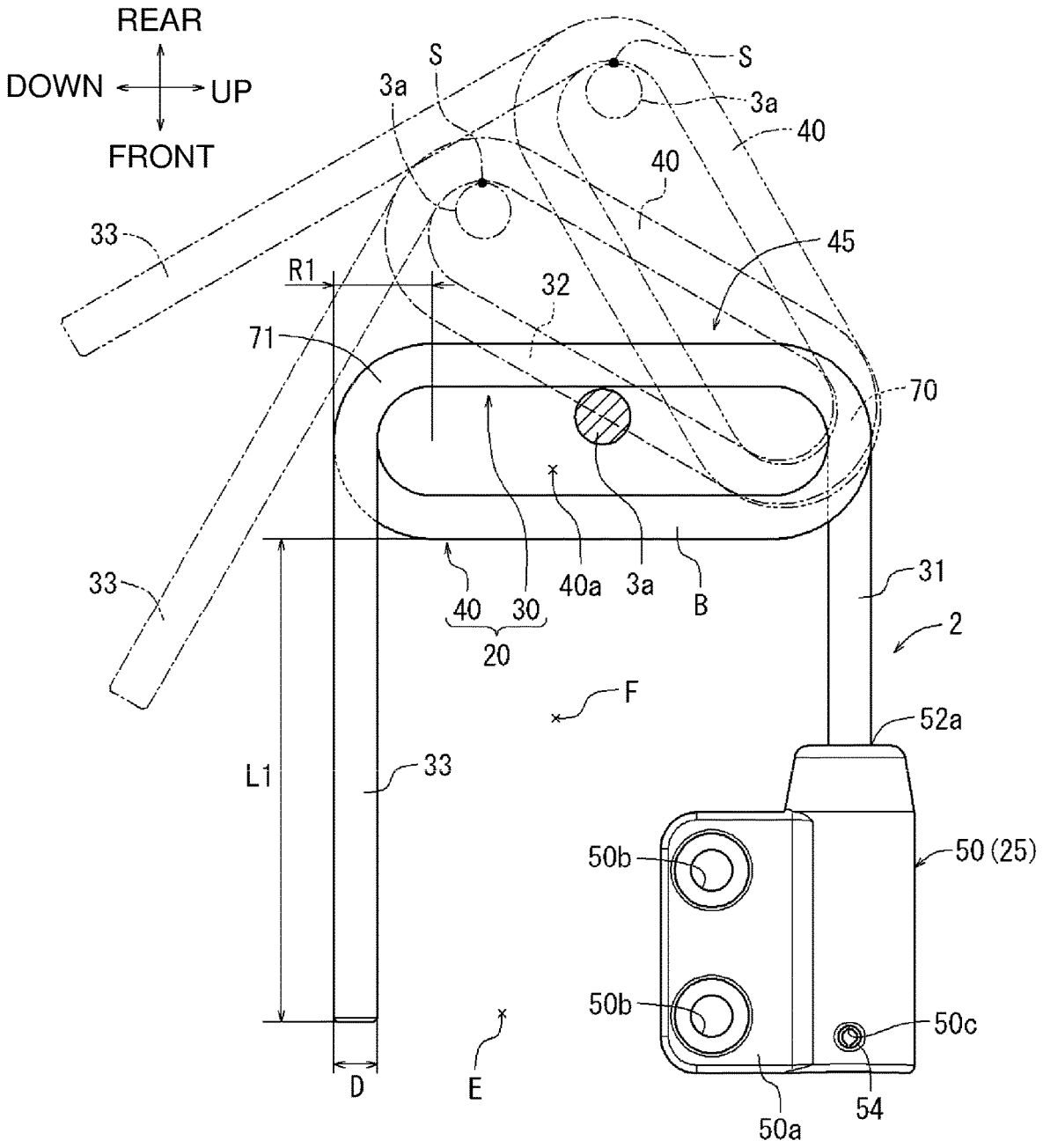
FIG. 10 is a right view of the tool holder in FIG. 5 deformed by shock from suspension resulting from falling of the power tool.

For example, in the first suspension resulting from falling of the power tool 1 (suspension resulting from the first fall), the carabiner 3*a* moves from the position indicated by a solid line to the position indicated by a one-dot chain line in FIG. 10. Upon completion of the movement, the annular portion 40 receives shock from the carabiner 3*a* suspended from falling through the point of shock application S. Thus, the bend (the first bend 70) of the holder body 20 deforms to open under the shock applied on the annular portion 40. The first bend 70 bent substantially 90° deforms to open to, for example, substantially 120° (in FIG. 10, the first bend 70 deforms from the position indicated by the solid line to the position indicated by the one-dot chain line). Thus, the deformation of the first bend 70 reliably absorbs the shock from the carabiner 3*a* suspended from falling.

For example, in the second suspension resulting from falling of the power tool 1, the carabiner 3*a* moves from the position indicated by the one-dot chain line to the position indicated by a two-dot chain line in FIG. 10. Upon completion of the movement, the annular portion 40 receives shock from the carabiner 3*a* suspended from falling. Thus, the bend (the first bend 70) of the holder body 20 deforms to open further under the shock applied on the annular portion 40. The first bend 70 bent substantially 120° deforms to open to, for example, substantially 150° (in FIG. 10, the first bend 70 deforms from the position indicated by the one-dot chain line to the position indicated by the two-dot chain line). Thus, the deformation of the first bend 70 reliably absorbs the shock from the carabiner 3*a* suspended from falling. The bend thus deforms stepwise to maintain the durability of the tool holder 2.

The point of shock application S that receives shock shifts between the first and second falls. The point of shock application S is a portion of the inner periphery (overlap 45) of the annular portion 40 to come in contact with the carabiner 3*a*. The shifting of the point of shock application S in each fall also increases the durability of the tool holder 2 against the multiple falls.

If the power tool 1 falls, the carabiner 3*a* consistently moves to the position farthest from the base 50 and the position farthest from the center of gravity Y of the power tool 1 inside the through-hole 40*a* in the annular portion 40, and the annular portion 40 receives shock. The bend (the first bend 70) of the holder body 20 thus efficiently deforms under shock applied on the annular portion 40. Thus, the shock from the carabiner 3*a* suspended from falling can be absorbed reliably.

When the suspension resulting from falling of the power tool 1 is repeated, the bend of the holder body 20 to deform is switched from the first bend 70 to the second, third, or fourth bend 43, 44, or 71 depending on the number of falls. In addition to the number of deformations of each bend, switching between the bends can also accommodate multiple falls, and more reliably maintains the durability of the tool holder 2 further.

When the bend of the holder body 20 deforms, an operator can visually recognize the deformation of the holder body 20. This reminds the operator of replacement or repair of the tool holder 2.

When the annular portion 40 receives shock from the carabiner 3*a* suspended from falling of the power tool 1, the shaft 31 is displaced with respect to the base 50 under the shock applied on the annular portion 40. In the shock-absorbing mechanism 25, the holder body 20 is moved relative to the base 50 while the elastic piece 21 and the compression spring 22 are compressed to absorb the shock applied on the annular portion 40. Thus, in addition to the deformation of the first bend 70, the shock-absorbing mechanism 25 can also absorb the shock applied on the annular portion 40 from the carabiner 3*a* suspended from falling of the power tool 1.

Figure 11:
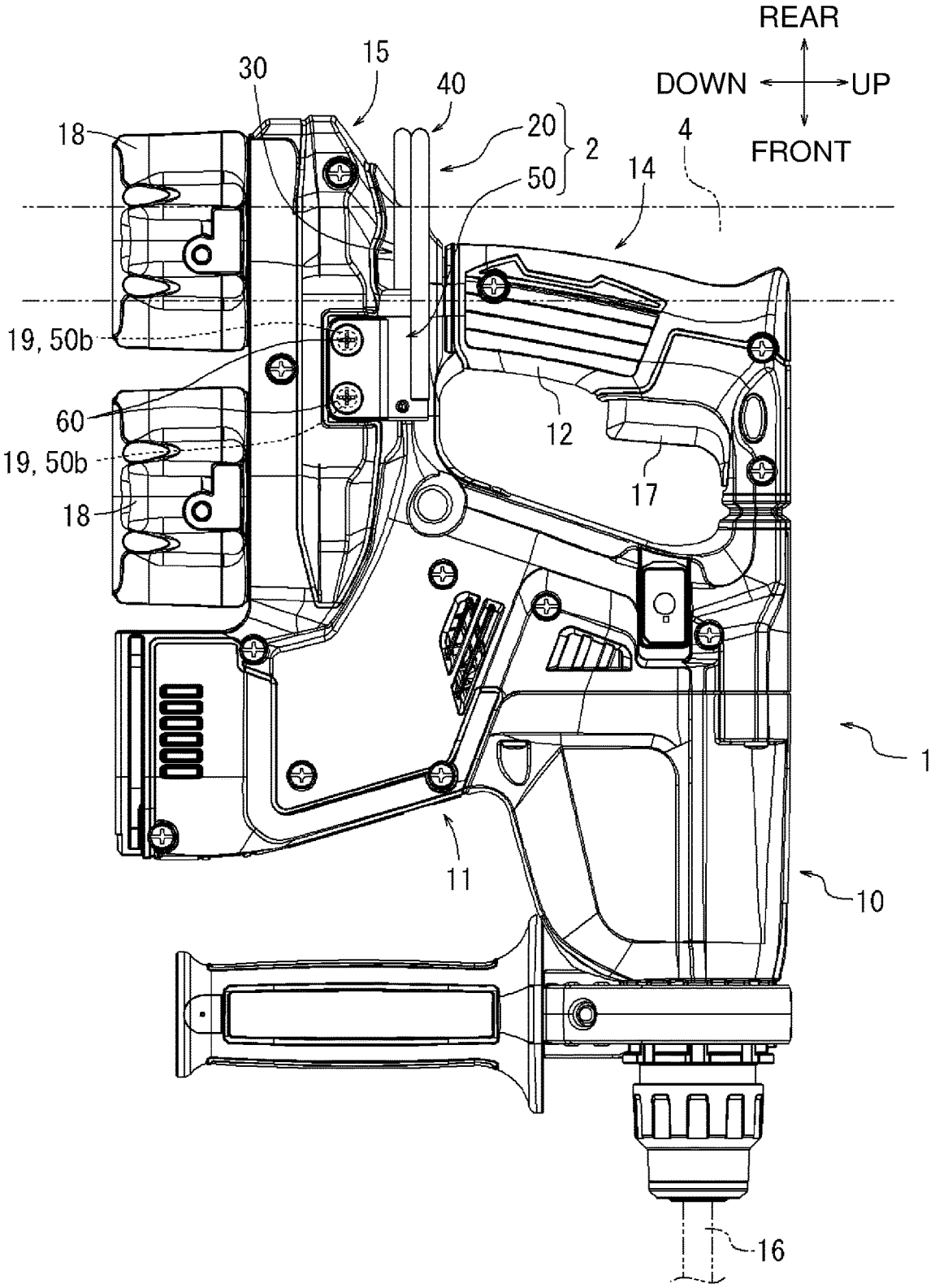
FIG. 11 is a view of the power tool in FIG. 3 hooked on a hook support such as a handrail.

The holder body 20 is switched to the pulled-out state to allow hooking of the hook portion 30 of the holder body 20 in the pulled-out state on the hook support 4, such as a handrail (refer to FIG. 11). Thus, while the power tool 1 is not in use, the power tool 1 can be hooked on the hook support 4, such as a handrail, using the hook portion 30 without using the suspension member 3.

In the power tool 1 and the tool holder 2 according to the first embodiment, the basal end of the cord 3*b* with the carabiner 3*a* passing through the through-hole 40*a* in the annular portion 40 can be tied to a suspension support at, for example, an elevated working site. More specifically, the annular portion 40 of the tool holder 2 attached to the power tool 1 can be tethered to the suspension support at, for example, an elevated working site with the suspension member 3. If the manually held power tool 1 is dropped accidentally, the dropped power tool 1 is suspended from the suspension support at, for example, an elevated working site with the suspension member 3. In other words, the power tool 1 is suspended from the suspension member 3 tethered to the suspension support at, for example, an elevated working site. Thus, the power tool 1 is prevented from falling on the ground. The annular portion 40 receives shock from the carabiner 3*a* suspended from falling. Thus, the bend (first to fourth bends 70, 43, 44, and 71) of the holder body 20 deforms under the shock applied on the annular portion 40. This deformation reliably absorbs the shock from the carabiner 3*a* suspended from falling.

The base 50 of the tool holder 2 according to the present embodiment is removably attached to the battery mount 15 of the power tool 1. Thus, the tool holder 2 can be retrofitted to the power tool 1. This structure enables two types of sales, or selling a power tool 1 incorporating a tool holder 2, and separately selling a power tool 1 and a retrofittable tool holder 2. The removably attached base 50 facilitates maintenance, such as replacement of the tool holder 2.

The holder body 20 according to the present embodiment includes the hook portion 30 and the annular portion 40. The hook portion 30 includes the shaft 31, the intermediate portion 32, and the distal end 33. The annular portion 40 includes the overlapping portion 41, the opposing portion 42, and the pair of second and third bends 43 and 44. The hook portion 30 can function as a hook by allowing the hook support 4, such as a handrail, at the working site to enter the hook area F, which is defined by the shaft 31, the annular portion 40 (hook bottom B), and the distal end 33. Thus, when not in use, the power tool 1 can be hooked on the hook support 4, such as a handrail, with the hook portion 30 without using the suspension member 3.

If the manually held power tool 1 according to the present embodiment is dropped accidentally while the annular portion 40 of the tool holder 2 attached to the power tool 1 is tethered to the suspension support 5 at the elevated working site with the suspension member 3, the point of shock application S of the annular portion 40 that receives shock from the carabiner 3*a* consistently shifts to the position farthest from the basal end 31*b* of the shaft 31 inside the through-hole 40*a*. The holder body 20 thus deforms at the position switching from the first bend 70 to the second, third, or fourth bend 43, 44, or 71 depending on the number of falls. This structure prevents the holder body 20 from deforming in a concentrated manner at one position. Thus, the tool holder 2 can bear multiple falls (e.g., three to five falls) of the power tool 1.

In the present embodiment, the intermediate portion 32 and the overlapping portion 41 of the holder body 20 overlap into the overlap 45. The overlap 45 includes a part of the annular portion 40 farther from the base 50. When, for example, the tool holder 2 is used while the cord 3*b* passes through the through-hole 40*a* without using the carabiner 3*a*, the cord 3*b* is prevented from moving through the through-hole 40*a* to the distal end 33 of the hook portion 30 along the inner surface of the annular portion 40. Thus, the cord 3*b* passing through the through-hole 40*a* is prevented from slipping off.

The annular portion 40 according to the present embodiment is wound inside the hook portion 30. Thus, the annular portion 40 is prevented from extending outward (rearward) from the hook portion 30. The resultant tool holder 2 has a smaller size.

The annular portion 40 according to the present embodiment extends between the shaft 31 and the distal end 33 of the hook portion 30 to serve as the entire hook bottom B. The annular portion 40 according to the present embodiment has a larger through-hole 40*a* than when, for example, the annular portion 40 is smaller without extending between the shaft 31 and the distal end 33 of the hook portion 30. This structure facilitates passing of the carabiner 3*a* through the through-hole 40*a*. The point of shock application S of shock from the carabiner 3*a* can fall within a wider area. Moreover, the annular portion 40 extending throughout the hook bottom B maintains the durability of the hook portion 30 as a hook.

The annular portion 40 according to the present embodiment is elliptic. The overlapping portion 41 and the opposing portion 42 of the annular portion 40 extending in the longitudinal direction are straight. This structure facilitates shifting of the point of shock application S of the annular portion 40 that receives shock from the carabiner 3*a*.

The shorter portions of the annular portion 40 according to the present embodiment include the second and third bends 43 and 44, which face each other and have a substantially semicircular shape. This structure can distribute the shock from the carabiner 3*a* applied on (prevent stress concentration on) the annular portion 40.

The tool holder 2 according to the present embodiment includes the shock-absorbing mechanism 25 placed between the holder body 20 and the base 50 to absorb shock while compressing the compression spring 22 and allowing the holder body 20 and the base 50 to move relative to each other. In addition to the deformation of the bend of the holder body 20, the shock-absorbing mechanism 25 can also absorb the shock applied on the annular portion 40 from the carabiner 3*a* suspended from falling of the power tool 1. Thus, the tool holder 2 has higher shock absorbency (damping capacity).

The holder body 20 according to the present embodiment is formed by bending a single wire (metal wire). The holder body 20 thus has a simple structure. The holder body 20 can be manufactured at lower cost while maintaining durability.

Second Embodiment

A second embodiment will now be described with reference to FIG. 12. Compared with the tool holder 2 according to the first embodiment, a tool holder 102 according to the second embodiment increases the hooking performance of the hook portion 30 on the hook support 4 such as a handrail. The components that are the same as or equivalent to those described in the first embodiment are given the same reference numerals in the drawings and will not be described repeatedly. The same applies to all the embodiments described below.

Figure 12:
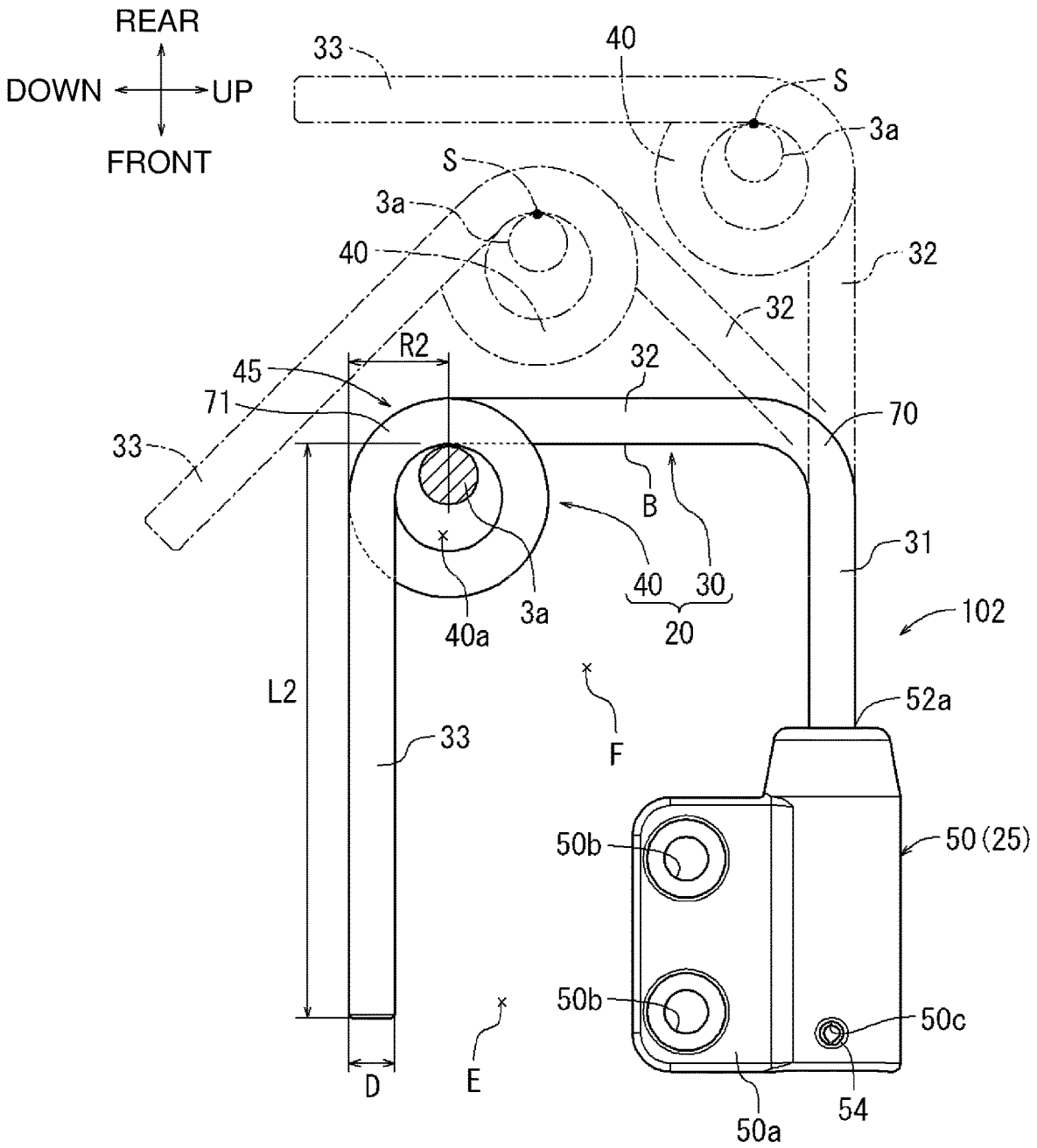
FIG. 12 is a right view of a tool holder according to a second embodiment deformed by shock from suspension resulting from falling of the power tool.

Similarly to the tool holder 2 according to the first embodiment, the tool holder 102 according to the second embodiment includes a holder body 20, a base 50, and a shock-absorbing mechanism 25 (refer to FIG. 12). The tool holder 102 has an annular portion 40 with a through-hole 40*a* having a smaller circular shape instead of an ellipse. The annular portion 40 has a radius R2 of about twice the diameter D of the wire. In other words, R2=2D (refer to FIG. 12).

The annular portion 40 is partially located at a lower end of the hook portion 30 to overlap the fourth bend 71. The annular portion 40 according to the second embodiment is smaller than in the first embodiment in the width direction (or in the vertical direction) of the opening E of the hook portion 30. Thus, a hooking depth L2 (depth to the hook bottom B) of the hook portion 30 according to the second embodiment is larger than a hooking depth L1 of the hook portion 30 according to the first embodiment. This structure enables stable hooking and further improves the function of the hook portion 30 as a hook.

Similarly to the tool holder 2 according to the first embodiment, the annular portion 40 of the tool holder 102 according to the second embodiment attached to the power tool 1 can be tethered to the suspension support 5 at, for example, an elevated working site with the suspension member 3 (the carabiner 3*a* and the cord 3*b*). If the manually held power tool 1 is dropped accidentally, the dropped power tool 1 is suspended from the suspension support 5 at, for example, an elevated working site with the suspension member 3. Thus, the power tool 1 is prevented from falling on a lower floor or on the ground (not shown).

For example, in the first suspension resulting from falling of the power tool 1 (suspension resulting from the first fall), the carabiner 3*a* moves from the position indicated by a solid line to the position indicated by a one-dot chain line in FIG. 12, and the point of shock application S shifts. Upon completion of the movement, the annular portion 40 receives shock from the carabiner 3*a* suspended from falling. Thus, the bend (the first bend 70) of the holder body 20 deforms to open under the shock applied on the annular portion 40. The first bend 70 bent substantially 90° deforms to open to, for example, substantially 135° (in FIG. 12, the first bend 70 deforms from the position indicated by the solid line to the position indicated by the one-dot chain line). Thus, the deformation of the first bend 70 reliably absorbs the shock from the carabiner 3*a* suspended from falling.

For example, in the second suspension resulting from falling of the power tool 1, the carabiner 3*a* moves from the position indicated by the one-dot chain line to the position indicated by a two-dot chain line in FIG. 12. Upon completion of the movement, the annular portion 40 receives shock from the carabiner 3*a* suspended from falling. Thus, the bend (the first bend 70) of the holder body 20 deforms to open further under the shock applied on the annular portion 40. The first bend 70 bent substantially 135° deforms to open to, for example, substantially 180° (in FIG. 12, the first bend 70 deforms from the position indicated by the one-dot chain line to the position indicated by the two-dot chain line). Thus, the deformation of the first bend 70 reliably absorbs the shock from the carabiner 3*a* suspended from falling.

The tool holder 102 according to the second embodiment produces the same effects as the tool holder 2 according to the first embodiment. In the hook portion 30 according to the second embodiment, the hooking depth L2 of the tool holder 102 is vertically larger than the hooking depth L1 of the tool holder 2 partially. Thus, the hooking performance of the hook portion 30 on the hook support 4, such as a handrail, can be improved.

Third Embodiment

A third embodiment will now be described with reference to FIG. 13. Unlike the tool holder 102 according to the second embodiment, a tool holder 202 according to the third embodiment includes an annular portion 40 located at an upper end of the hook portion 30 instead of at the lower end of the hook portion 30. The annular portion 40 located at the upper end of the hook portion 30 instead of at the lower end of the hook portion 30 enables selection of the vertical position of the hooking depth L2 depending on the purpose of use. Thus, the selectable range of the tool holder 2 can be widened.

Similarly to the tool holder 102 according to the second embodiment, the tool holder 202 according to the third embodiment includes a holder body 20 and a base 50. A shock-absorbing mechanism 25 is placed between the holder body 20 and the base 50 to absorb shock by allowing relative movement between the holder body 20 and the base 50. The annular portion 40 partially overlaps the first bend 70.

As in the tool holder 102 according to the second embodiment, in the tool holder 202 according to the third embodiment, the annular portion 40 of the tool holder 202 attached to the power tool 1 can be tethered to the suspension support 5 at, for example, an elevated working site with the suspension member 3 (the carabiner 3*a* and the cord 3*b*). If the manually held power tool 1 is dropped accidentally, the dropped power tool 1 can be suspended from the suspension support 5 at, for example, an elevated working site with the suspension member 3. Thus, the power tool 1 is prevented from falling on a lower floor or on the ground (not shown).

Figure 13:
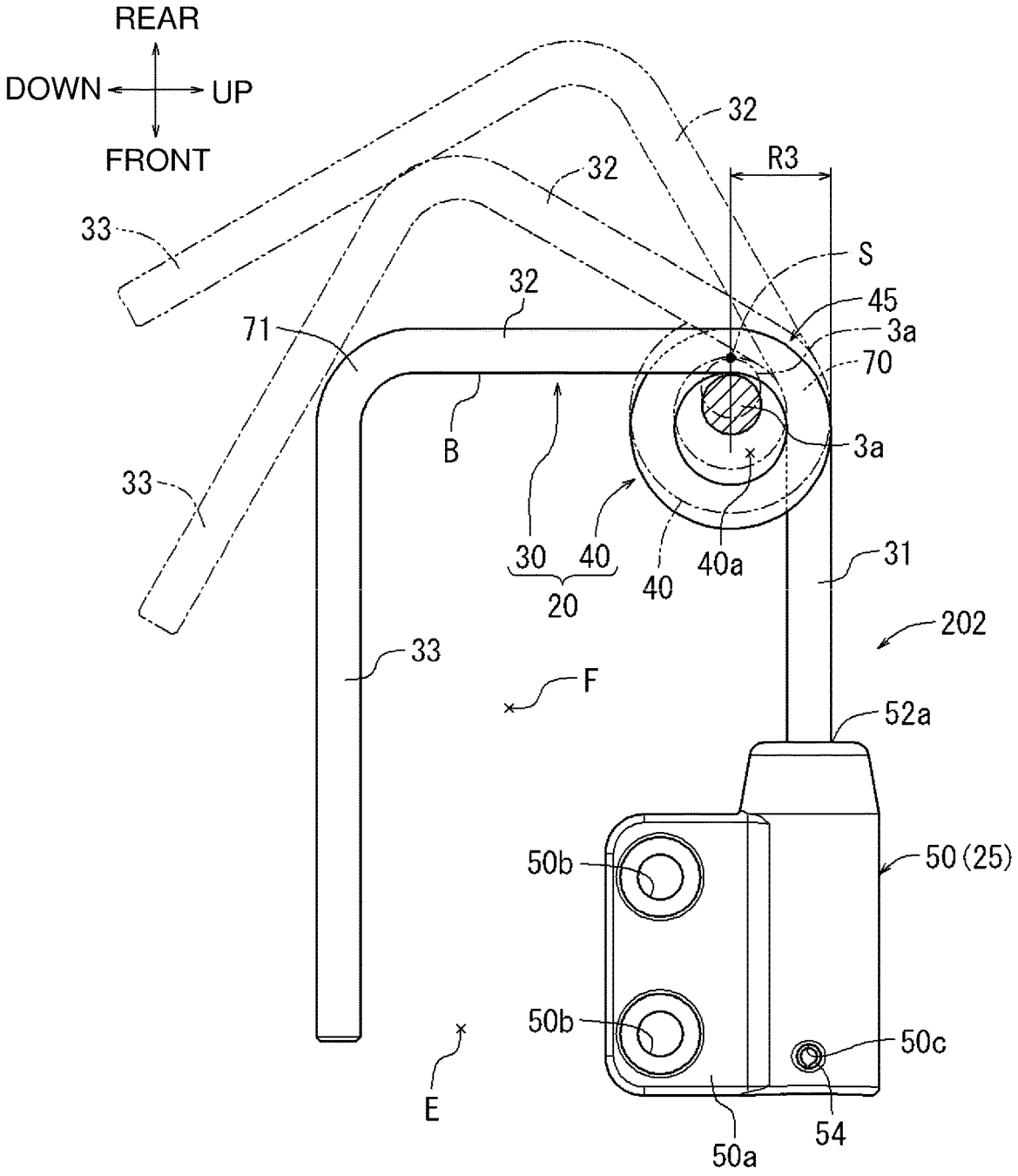
FIG. 13 is a right view of a tool holder according to a third embodiment deformed by shock from suspension resulting from falling of the power tool.

For example, in the first suspension resulting from falling of the power tool 1 (suspension resulting from the first fall), the carabiner 3*a* moves from the position indicated by a solid line to the position indicated by a one-dot chain line in FIG. 13. Upon completion of the movement, the annular portion 40 receives shock from the carabiner 3*a* suspended from falling. Thus, the bend (the first bend 70) of the holder body 20 deforms to open under the shock applied on the annular portion 40. The first bend 70 bent substantially 90° deforms to open to substantially 120° (in FIG. 13, the first bend 70 deforms from the position indicated by the solid line to the position indicated by the one-dot chain line). Thus, the deformation of the first bend 70 reliably absorbs the shock from the carabiner 3*a* suspended from falling.

For example, in the second suspension resulting from falling of the power tool 1, the carabiner 3*a* moves from the position indicated by the one-dot chain line to the position indicated by a two-dot chain line in FIG. 13, and the point of shock application S shifts. Upon completion of the movement, the annular portion 40 receives shock from the carabiner 3*a* suspended from falling. Thus, the bend (the first bend 70) of the holder body 20 deforms to open further under the shock applied on the annular portion 40. The first bend 70 bent substantially 120° deforms to open to, for example, substantially 150° (in FIG. 13, the first bend 70 deforms from the position indicated by the one-dot chain line to the position indicated by the two-dot chain line). Thus, the deformation of the first bend 70 reliably absorbs the shock from the carabiner 3*a* suspended from falling. The deformation of the first bend 70 also causes slight deformation of the annular portion 40.

The tool holder 202 according to the third embodiment produces the same effects as the tool holder 102 according to the second embodiment.

Fourth Embodiment

A fourth embodiment will now be described with reference to FIG. 14. A tool holder 302 according to the fourth embodiment has a simpler structure than the tool holder 202 according to the third embodiment.

Similarly to the tool holder 202 according to the third embodiment, the tool holder 302 according to the fourth embodiment includes a holder body 20 and a base 50. A shock-absorbing mechanism 25 is placed between the holder body 20 and the base 50 to absorb shock by allowing relative movement between the holder body 20 and the base 50. The annular portion 40 is manufactured as a member separate from the hook portion 30. The annular portion 40 is immovably coupled to the intermediate portion 32 of the hook portion 30 with a metal coupler 40*b* formed from a solid material (such as a metal).

Similarly to the tool holder 202 according to the third embodiment, the annular portion 40 of the tool holder 302 according to the fourth embodiment attached to the power tool 1 can be tethered to the suspension support 5 at, for example, an elevated working site with the suspension member 3 (the carabiner 3*a* and the cord 3*b*). If the manually held power tool 1 is dropped accidentally, the dropped power tool 1 is suspended from the suspension support 5 at, for example, an elevated working site with the suspension member 3. Thus, the power tool 1 is prevented from falling on a lower floor or on the ground (not shown).

Figure 14:
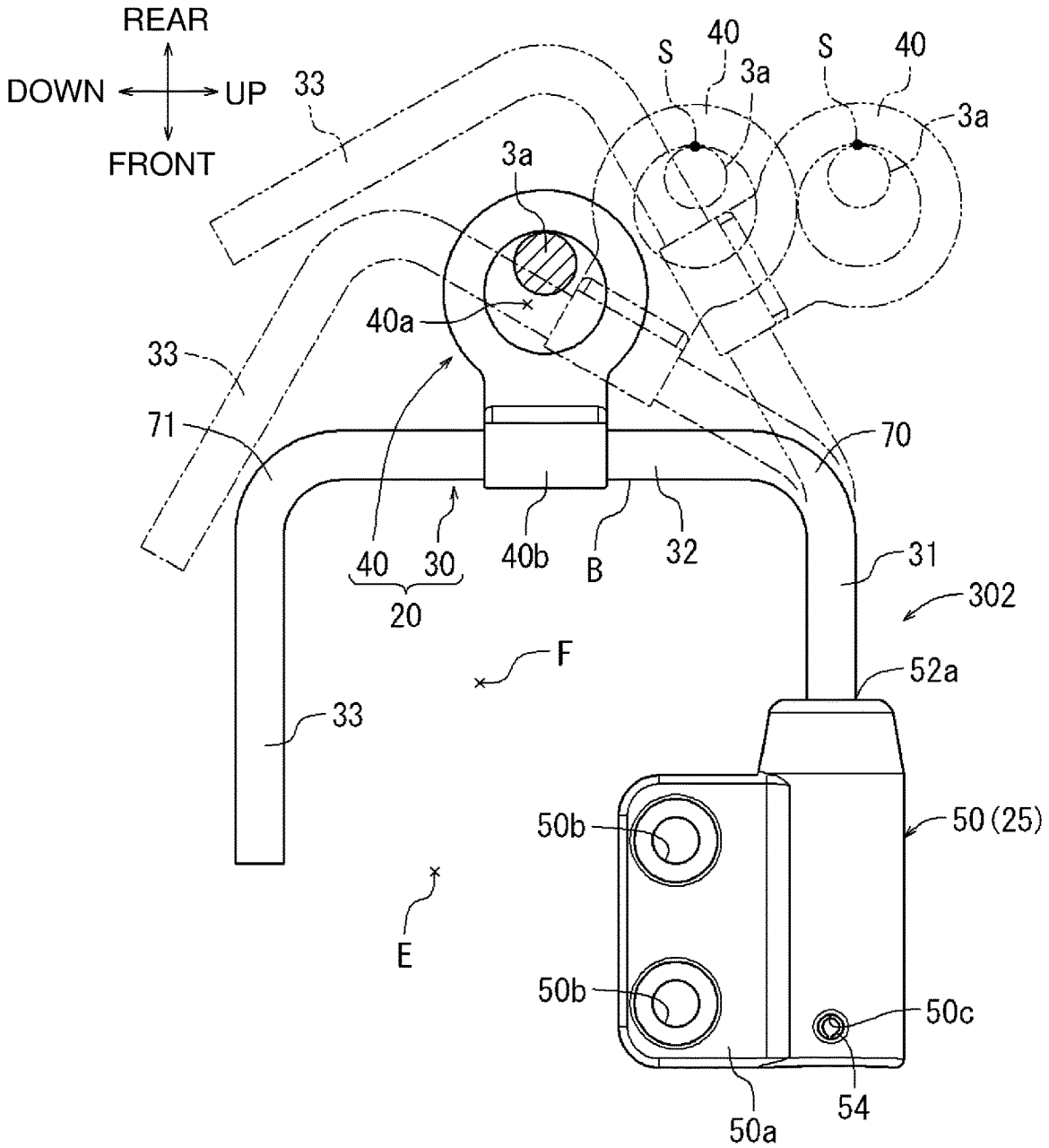
FIG. 14 is a right view of a tool holder according to a fourth embodiment deformed by shock from suspension resulting from falling of the power tool.

For example, in the first suspension resulting from falling of the power tool 1 (suspension resulting from the first fall), the carabiner 3*a* moves from the position indicated by a solid line to the position indicated by a one-dot chain line in FIG. 14. Upon completion of the movement, the annular portion 40 receives shock from the carabiner 3*a* suspended from falling. Thus, the bend (the first bend 70) of the holder body 20 deforms to open under the shock applied on the annular portion 40. The first bend 70 bent substantially 90° deforms to open to substantially 120° (in FIG. 14, the first bend 70 deforms from the position indicated by the solid line to the position indicated by the one-dot chain line). Thus, the deformation of the first bend 70 reliably absorbs the shock from the suspension member 3 resulting from falling.

For example, in the second suspension resulting from falling of the power tool 1, the carabiner 3*a* moves from the position indicated by the one-dot chain line to the position indicated by a two-dot chain line in FIG. 14, and the point of shock application S shifts. Upon completion of the movement, the annular portion 40 receives shock from the carabiner 3*a* suspended from falling. Thus, the bend (the first bend 70) of the holder body 20 deforms to open further under the shock applied on the annular portion 40. The first bend 70 bent substantially 120° deforms to open to substantially 150° (in FIG. 14, the first bend 70 deforms from the position indicated by the one-dot chain line to the position indicated by the two-dot chain line). Thus, the deformation of the first bend 70 reliably absorbs the shock from the suspension member 3 resulting from falling.

The tool holder 302 according to the fourth embodiment produces the same effects as the tool holder 202 according to the third embodiment. The annular portion 40 according to the present embodiment is a component separate from the hook portion 30. Thus, the manufacturing processes for the tool holder 302 does not include bending the annular portion 40 to be integral with the hook portion 30. This simplifies the manufacture of the tool holder 302 according to the fourth embodiment as compared with the tool holder 202 according to the third embodiment.

Fifth Embodiment

Figure 15:
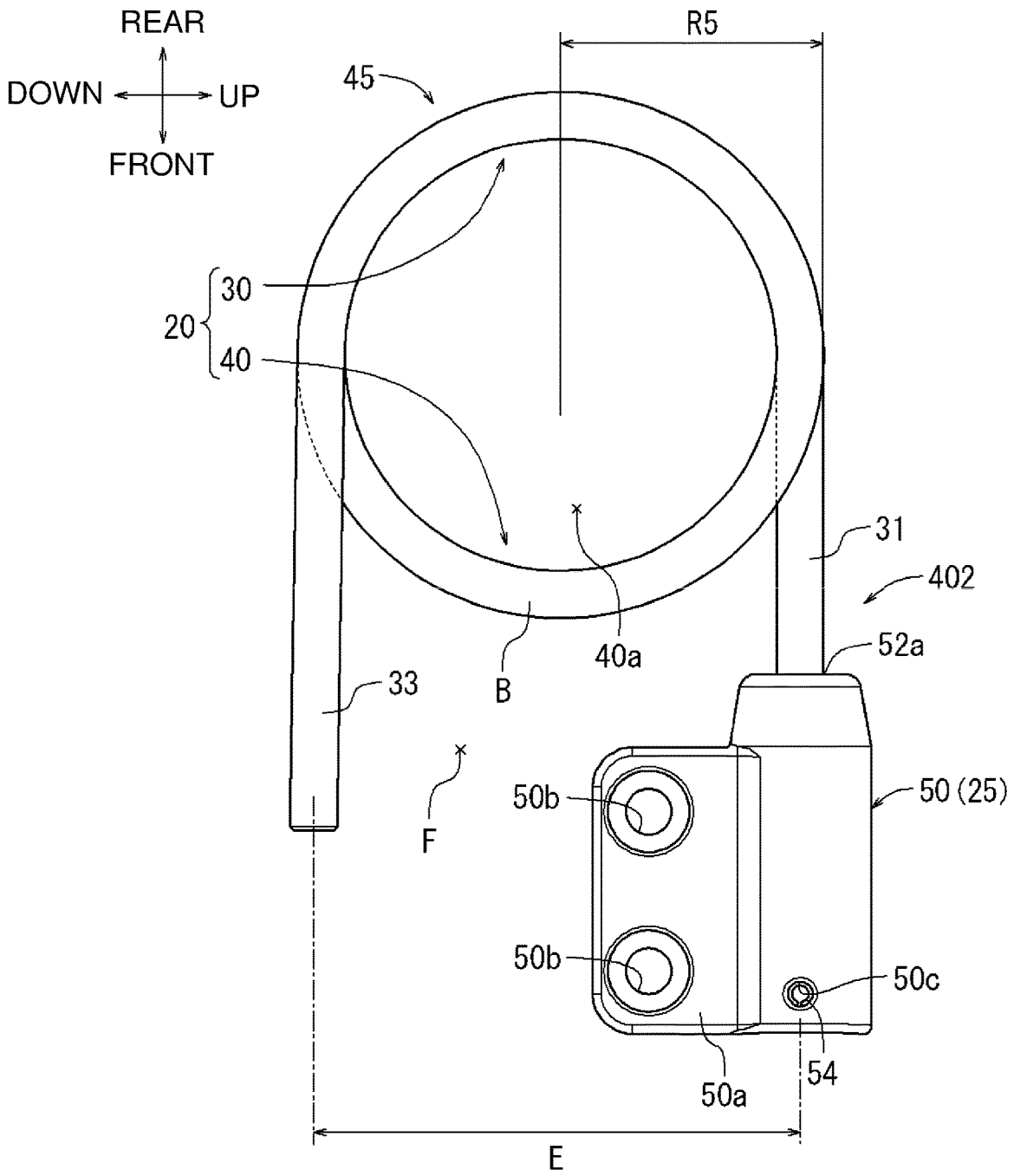
FIG. 15 is a right view of a tool holder according to a fifth embodiment.

A fifth embodiment will now be described with reference to FIG. 15. A tool holder 402 according to the fifth embodiment can more efficiently distribute the shock from the suspension member 3 applied on the annular portion 40 (more efficiently prevent stress concentration) than the tool holder 202 according to the third embodiment.

Similarly to the tool holder 202 according to the third embodiment, the tool holder 402 according to the fifth embodiment includes a holder body 20 and a base 50. A shock-absorbing mechanism 25 is placed between the holder body 20 and the base 50 to absorb shock by allowing relative movement between the holder body 20 and the base 50. The annular portion 40 has a large annular shape extending between the shaft 31 and the distal end 33 of the hook portion 30. More specifically, the annular portion 40 of the tool holder 402 has a radius R5 sufficiently larger than the radius R3 of the annular portion 40 of the tool holder 202 according to the third embodiment. The annular portion 40 according to the fifth embodiment has an annular shape having a diameter substantially equal to the width of the opening E of the hook portion 30 functioning as a hook. A space between the shaft 31 and the distal end 33 serves as a hook area F, and a semicircular area of the annular portion 40 nearer the base 50 functions as a hook bottom B.

The tool holder 402 according to the fifth embodiment produces the same effects as the tool holder 202 according to the third embodiment. The radius R5 of the annular portion 40 according to the present embodiment is sufficiently larger than the radius R3 of the annular portion 40 of the tool holder 202. This structure can thus more efficiently distribute the shock from the suspension member 3 applied on the annular portion 40 of the tool holder 402. The hook portion 30 has higher solidity.

Sixth Embodiment

Figure 16:
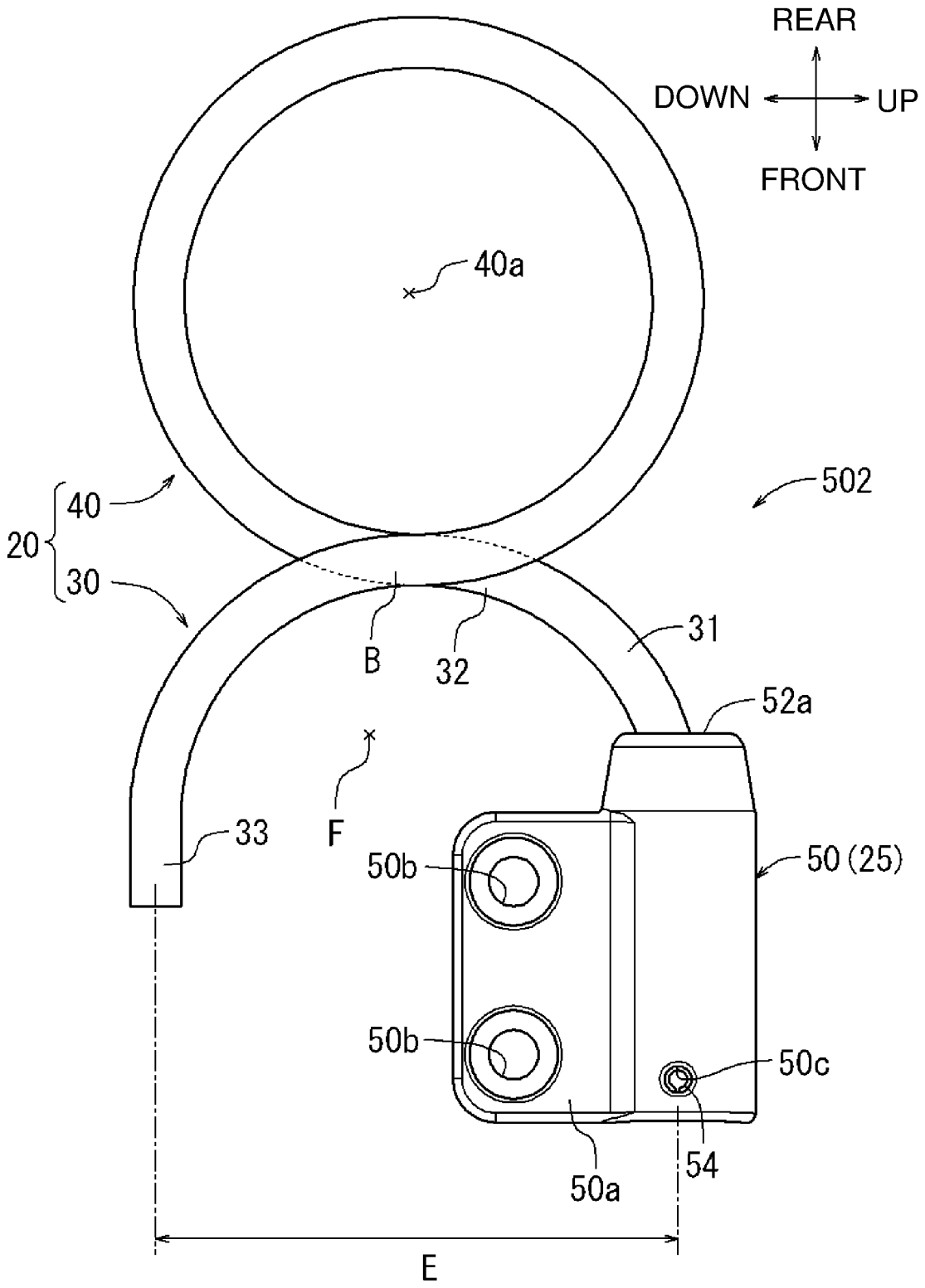
FIG. 16 is a right view of a tool holder according to a sixth embodiment.

A sixth embodiment will now be described with reference to FIG. 16. A tool holder 502 according to a sixth embodiment facilitates a switching operation of the holder body 20 (switching between the retracted and pulled-out states), as compared with the tool holder 402 according to the fifth embodiment.

Similarly to the tool holder 402 according to the fifth embodiment, the tool holder 502 according to the sixth embodiment includes a holder body 20 and a base 50. A shock-absorbing mechanism 25 is placed between the holder body 20 and the base 50 to absorb shock by allowing relative movement between the holder body 20 and the base 50. The annular portion 40 is wound outside the hook portion 30. The annular portion 40 has an annular shape with a diameter substantially equal to the width of the opening E. A space between the shaft 31 and the distal end 33 serves as a hook area F, and a semicircular area of the annular portion 40 nearer the base 50 functions as a hook bottom B.

The tool holder 502 according to the sixth embodiment produces the same effects as the tool holder 402 according to the fifth embodiment. The annular portion 40 according to the present embodiment is wound outside the hook portion 30. Thus, the annular portion 40 of the tool holder 502 extends rearward from the hook portion 30. Thus, the holder body 20 can be switched by gripping the annular portion 40, in addition to the operation on the hook portion 30. This structure facilitates pulling-out and retraction of the holder body 20.

Seventh Embodiment

Figure 17:
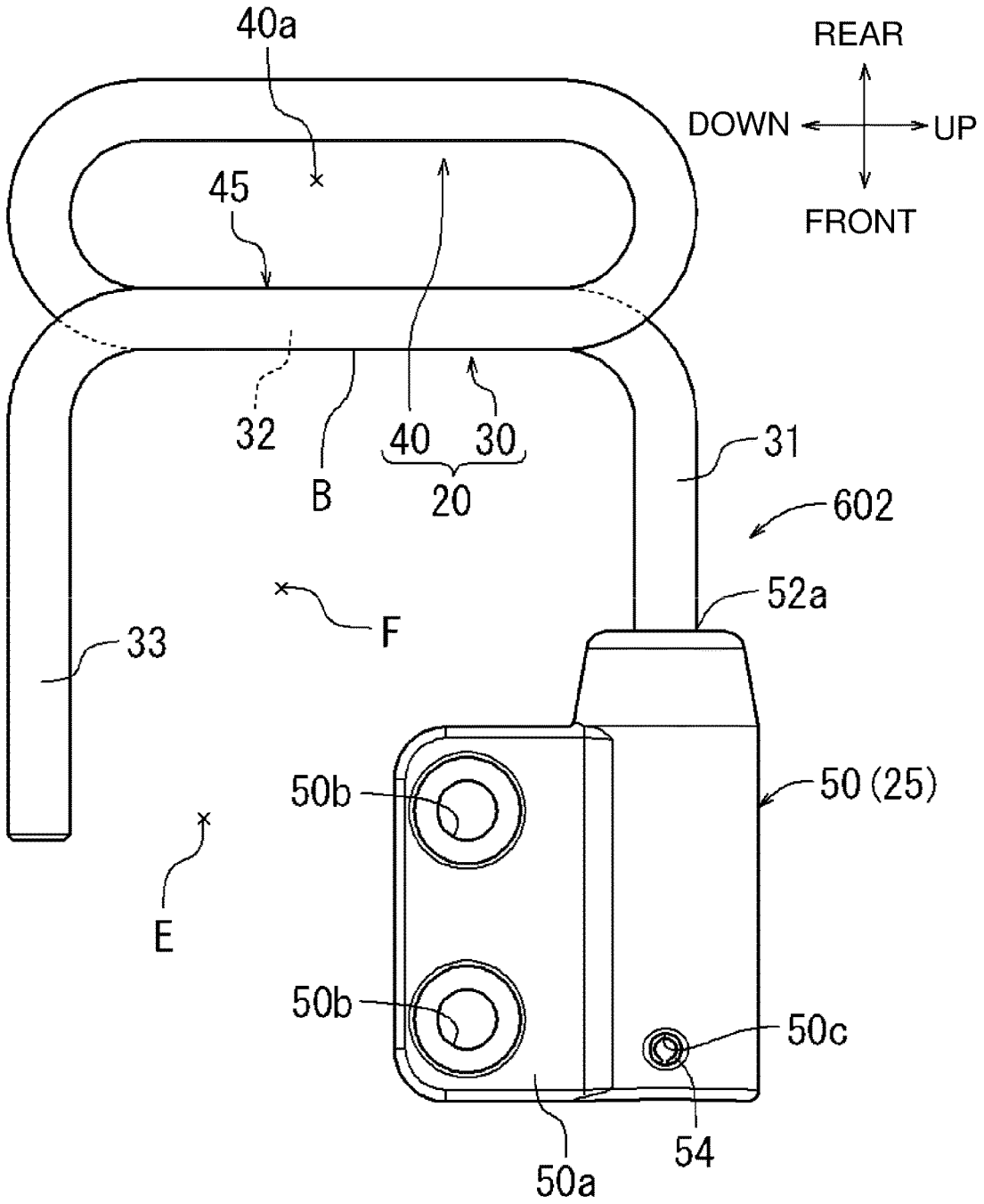
FIG. 17 is a right view of a tool holder according to a seventh embodiment.

A seventh embodiment will now be described with reference to FIG. 17. A tool holder 602 according to the seventh embodiment facilitates the switching operation of the holder body 20 (switching between the retracted and pulled-out states), as compared with the tool holder 2 according to the first embodiment.

Similarly to the tool holder 2 according to the first embodiment, the tool holder 602 according to the seventh embodiment includes a holder body 20, a base 50, and a shock-absorbing mechanism 25. The annular portion 40 is wound outside the hook portion 30 (wound outside the U shape).

The tool holder 602 according to the seventh embodiment produces the same effects as the tool holder 2 according to the first embodiment. The annular portion 40 according to the present embodiment is wound outside the hook portion 30. Thus, the annular portion 40 of the tool holder 602 extends rearward from the hook portion 30. Thus, the holder body 20 can be switched by gripping the annular portion 40, in addition to the operation on the hook portion 30. This structure facilitates pulling-out and retraction of the holder body 20.

Eighth Embodiment

Figure 18:
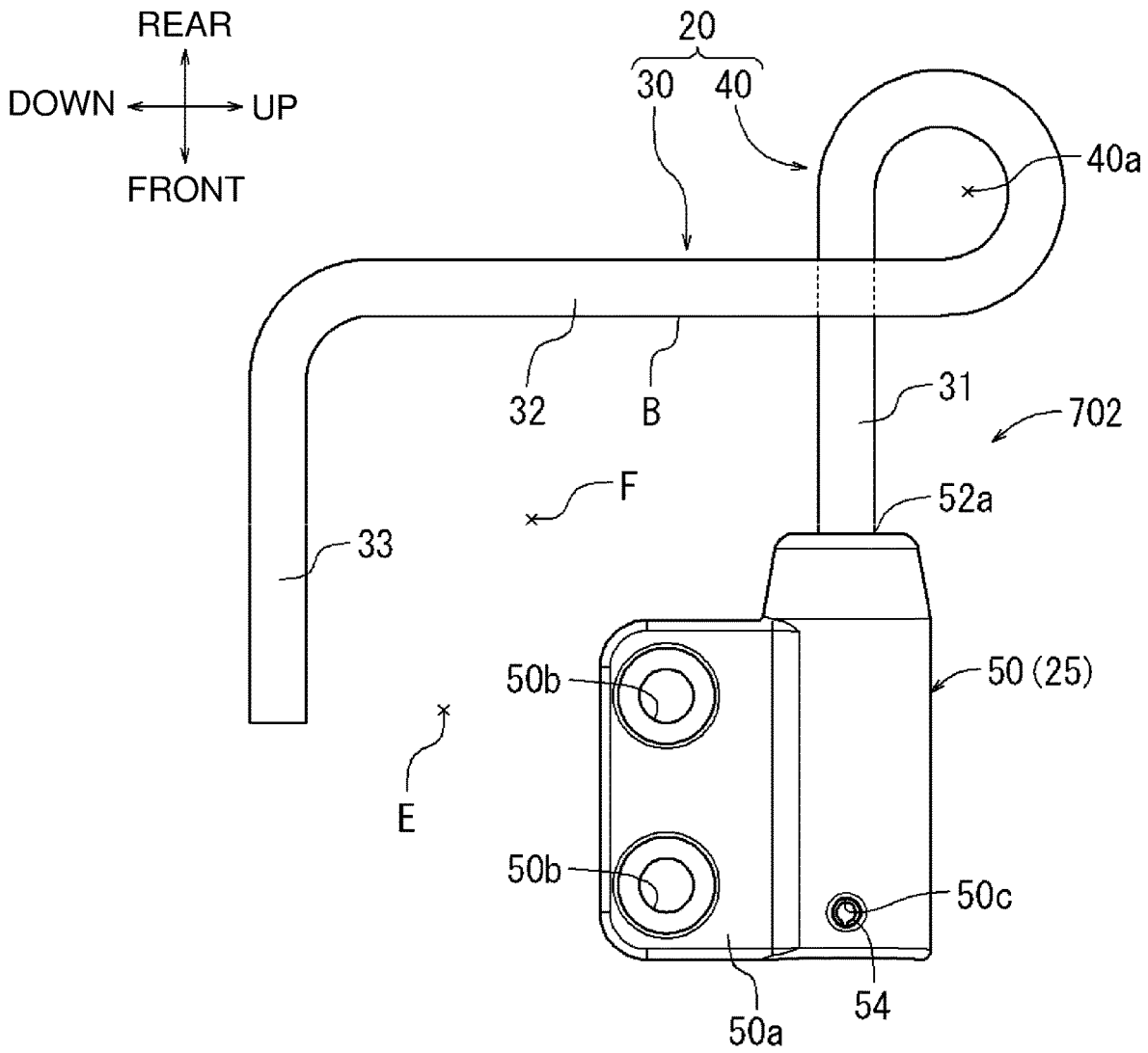
FIG. 18 is a right view of a tool holder according to an eighth embodiment.

An eighth embodiment will now be described with reference to FIG. 18. A tool holder 702 according to the eighth embodiment facilitates the switching operation of the holder body 20 (switching between the retracted and pulled-out states), as compared with the tool holder 202 according to the third embodiment.

Similarly to the tool holder 202 according to the third embodiment, the tool holder 702 according to the eighth embodiment includes a holder body 20, a base 50, and a shock-absorbing mechanism 25. The annular portion 40 is wound outside the hook portion 30.

As in the above embodiments, when the hook portion 30 is used, the hook support 4 relatively enters the opening E to come in contact with the hook bottom B. Thus, the hook support 4 enters the hook area F between the shaft 31 and the distal end 33 to allow the power tool 1 to be hooked on the hook support 4.

The tool holder 702 according to the eighth embodiment produces the same effects as the tool holder 202 according to the third embodiment. The annular portion 40 according to the present embodiment is wound outside the hook portion 30. Thus, the annular portion 40 of the tool holder 702 extends rearward from the hook portion 30. Thus, the holder body 20 can be switched by gripping the annular portion 40, in addition to the operation on the hook portion 30. This structure facilitates pulling-out and retraction of the holder body 20.

Ninth Embodiment

Figure 19:
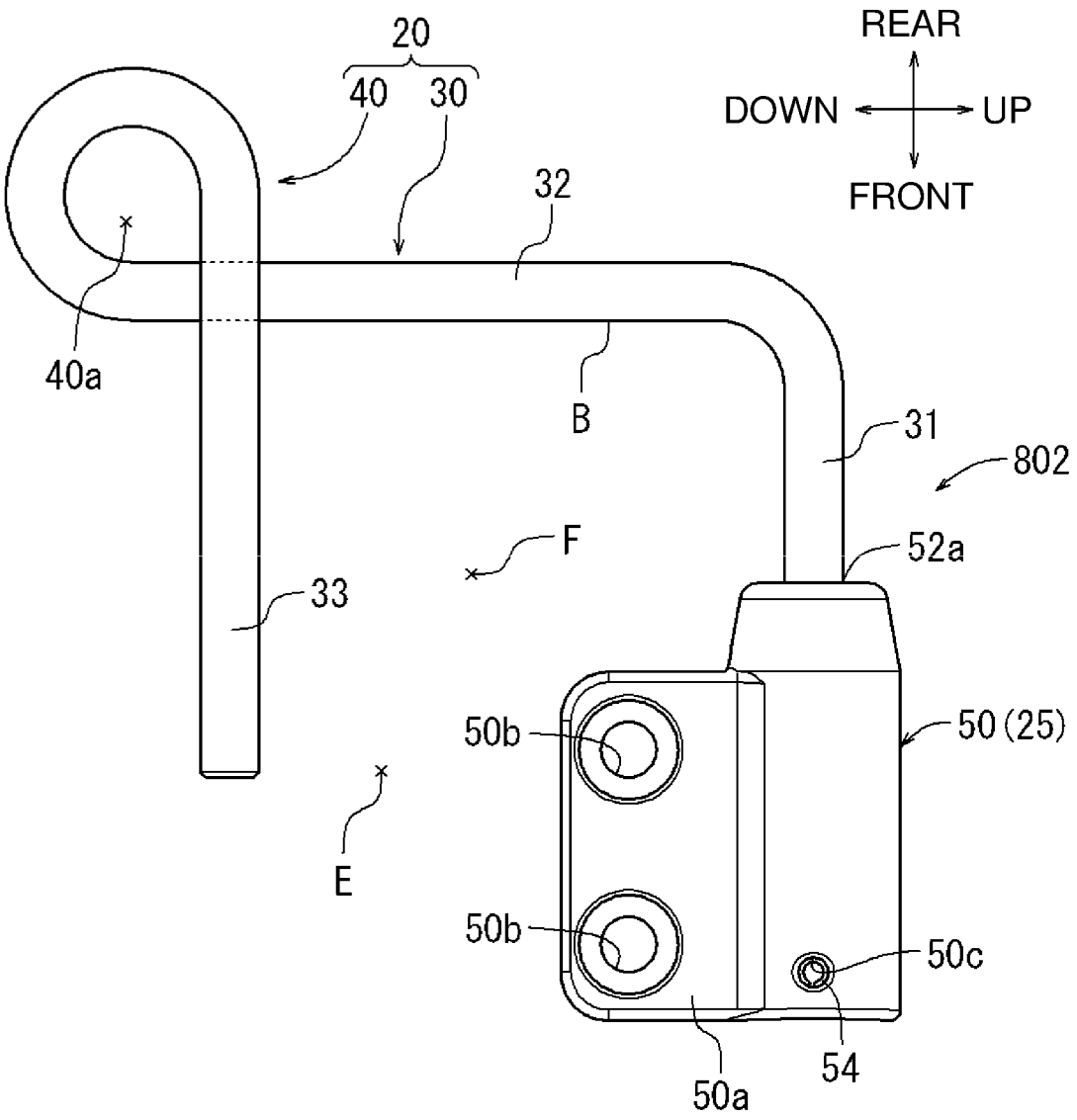
FIG. 19 is a right view of a tool holder according to a ninth embodiment.

A ninth embodiment will now be described with reference to FIG. 19. A tool holder 802 according to the ninth embodiment facilitates the switching operation of the holder body 20 (switching between the retracted and pulled-out states), as compared with the tool holder 102 according to the second embodiment.

Similarly to the tool holder 102 according to the second embodiment, the tool holder 802 according to the ninth embodiment includes a holder body 20, a base 50, and a shock-absorbing mechanism 25. The annular portion 40 is wound outside the hook portion 30.

The tool holder 802 according to the ninth embodiment produces the same effects as the tool holder 102 according to the second embodiment. The annular portion 40 according to the present embodiment is located on the outer periphery of the U-shaped hook portion 30. Thus, the annular portion 40 of the tool holder 802 extends rearward from the hook portion 30. Thus, the holder body 20 can be switched by gripping the annular portion 40, in addition to the operation on the hook portion 30. This structure facilitates pulling-out and retraction of the holder body 20.

Tenth Embodiment

Figure 20:
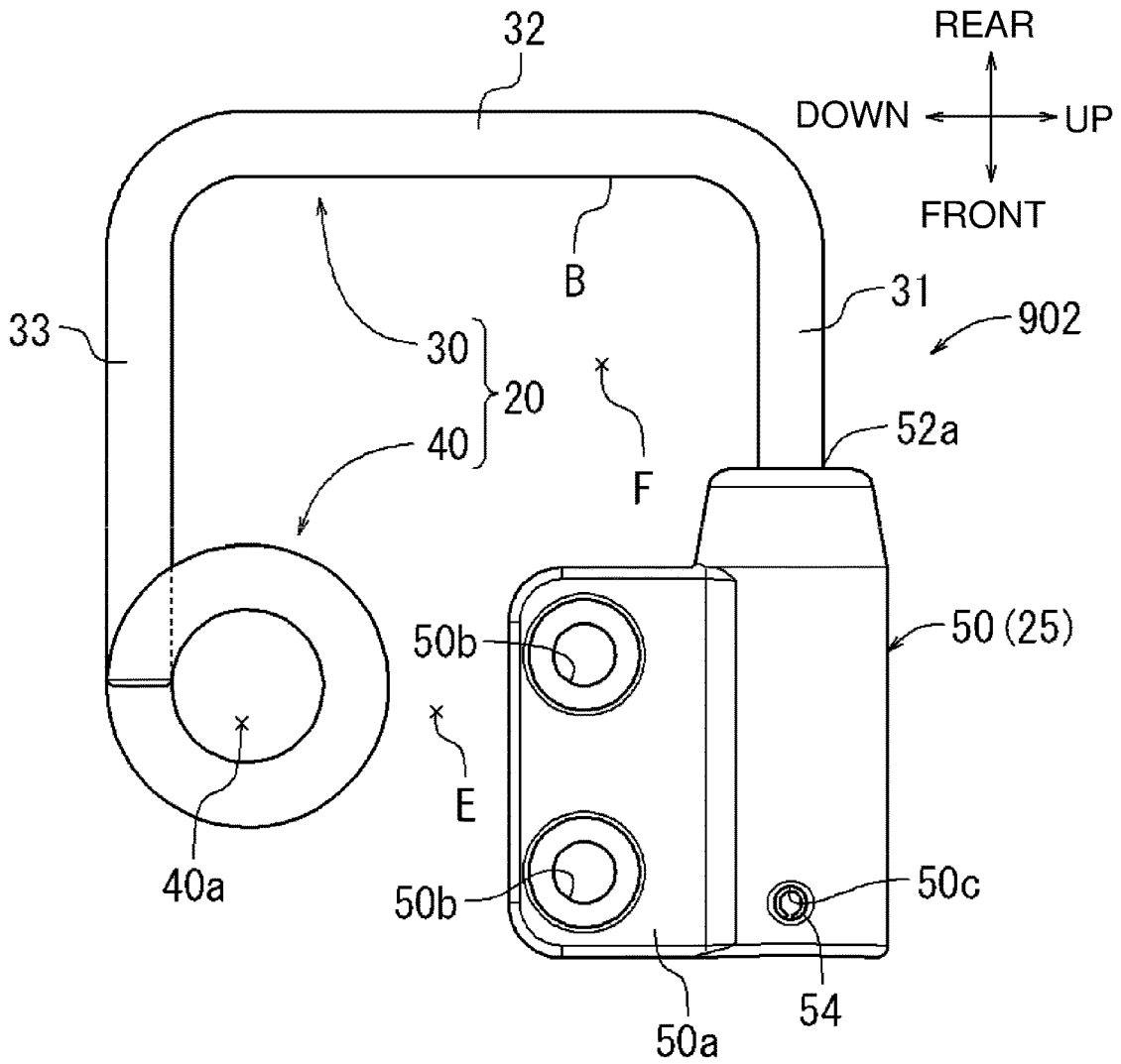
FIG. 20 is a right view of a tool holder according to a tenth embodiment.

A tenth embodiment will now be described with reference to FIG. 20. A tool holder 902 according to the tenth embodiment increases the hooking performance of the hook portion 30 on the hook support 4, such as a handrail or scaffold at a working site, compared with the tool holder 102 according to the second embodiment.

Similarly to the tool holder 102 according to the second embodiment, the tool holder 902 according to the tenth embodiment includes a holder body 20, a base 50, and a shock-absorbing mechanism 25. The annular portion 40 according to the present embodiment is located at the tip of the distal end 33 of the hook portion 30. The annular portion 40 according to the present embodiment is located inside the U-shaped hook portion 30.

In the tenth embodiment, a space between the annular portion 40 and the shaft 31 serves as the opening E of the hook portion 30, and the intermediate portion 32 functions as the hook bottom B. The power tool 1 can be hooked on the hook support 4 in the hook area F between the shaft 31 and the distal end 33.

The tool holder 902 according to the tenth embodiment produces the same effects as the tool holder 102 according to the second embodiment. The annular portion 40 according to the present embodiment is located at the tip of the distal end 33 of the hook portion 30. Thus, when a force is applied in the falling direction on the power tool 1 hooked on the hook support 4, such as a handrail, with the hook portion 30 of the tool holder 902, the annular portion 40 interferes with the hook support 4 such as a handrail. Thus, the hook portion 30 is less easily unhooked from the hook support 4 such as a handrail. Thus, the hooking performance of the hook portion 30 on the hook support 4, such as a handrail, can be improved.

Eleventh Embodiment

Figure 21:
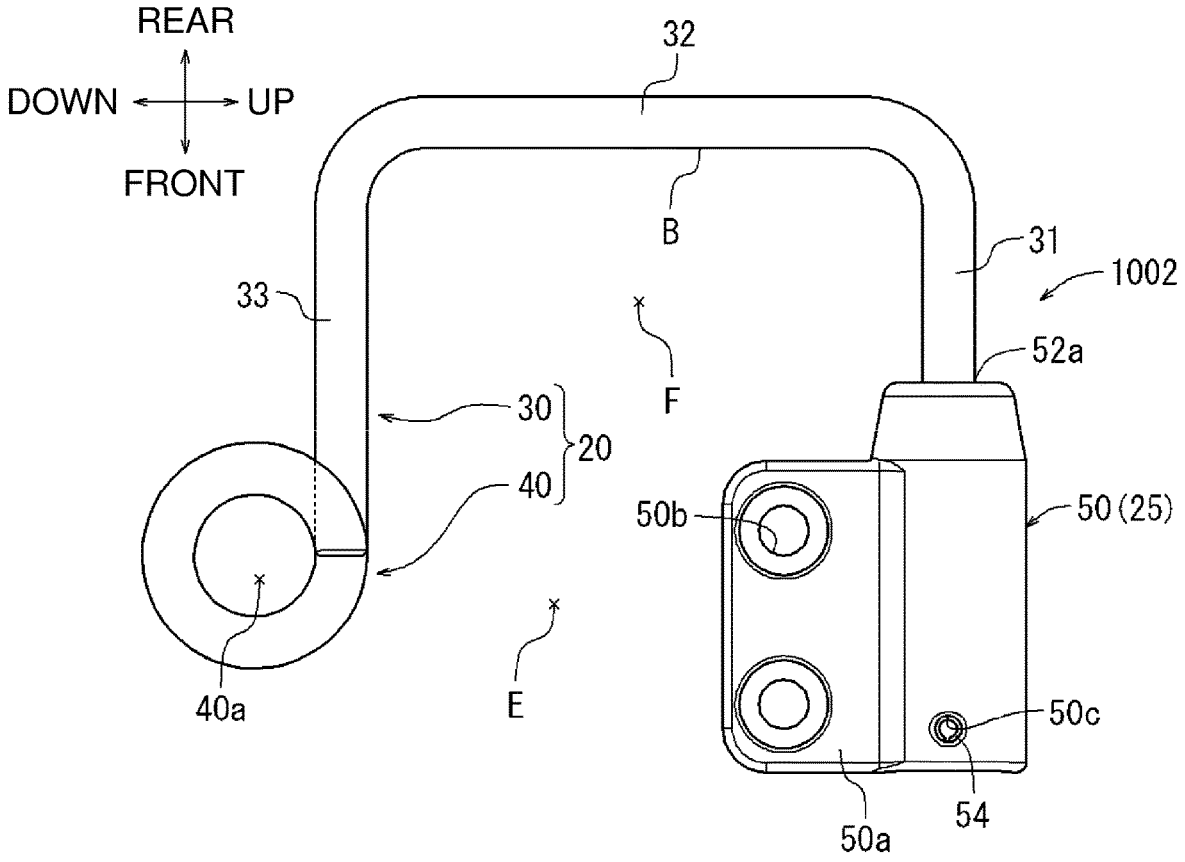
FIG. 21 is a right view of a tool holder according to an eleventh embodiment.

An eleventh embodiment will now be described with reference to FIG. 21. A tool holder 1002 according to the eleventh embodiment facilitates the switching operation of the holder body 20 (switching between the retracted and pulled-out states), as compared with the tool holder 802 according to the ninth embodiment.

Similarly to the tool holder 802 according to the ninth embodiment, the tool holder 1002 according to the eleventh embodiment includes a holder body 20, a base 50, and a shock-absorbing mechanism 25. The annular portion 40 is formed outside the U-shaped hook portion 30.

In the eleventh embodiment, a space between the annular portion 40 and the shaft 31 serves as the opening E of the hook portion 30, and the intermediate portion 32 functions as the hook bottom B. The opening E is wider than in the tenth embodiment. The power tool 1 can be hooked on the hook support 4 in contact with the hook bottom B and in the hook area F between the shaft 31 and the distal end 33.

The tool holder 1002 according to the eleventh embodiment produces the same effects as the tool holder 802 according to the ninth embodiment. The annular portion 40 according to the present embodiment is located outside the hook portion 30. The annular portion 40 of the tool holder 1002 extends downward from the hook portion 30. Thus, the holder body 20 can be switched by gripping the annular portion 40, in addition to the operation on the hook portion 30. This structure facilitates switching of the holder body 20.

In the above embodiments, the deformation of the first bend 70 also causes slight deformation of the annular portion 40. This slight deformation of the annular portion 40 can increase the absorbency of shock from the carabiner 3*a* suspended from falling of the power tool 1.

The base 50 in each embodiment described above may have the structure partly modified as appropriate in the manner described above. For example, instead of including the elastic piece 21 and the compression spring 22 in combination, the shock-absorbing mechanism 25 may include the elastic piece 21 or the compression spring 22 alone. The shock-absorbing mechanism 25 may simply be one of a mechanical spring, a disc spring, and polyurethane, or any combination of at least two of these.

The structure according to each of the first to eleventh embodiments uses compression with the compression spring 22 in the shock-absorbing mechanism 25, but may use compression with air, gas, liquid, or another fluid. In each embodiment, a hammer drill is an example of the power tool 1, but the power tool may be any electric tool, air tool, or engine tool.

In the first to eleventh embodiments, the second spring pin 54 is located on the base 50, and the first notch groove 23*d*, the second notch groove 23*e*, and the flat portions 23*f* are located on the basal end wall 23*c* of the spring stopper 23. Instead, the second spring pin 54 may be located on the shaft 31 of the holder body 20, and the first notch groove 23*d*, the second notch groove 23*e*, and the flat portions 23*f* may be located on the wall 52 of the base 50.

Figure 22:
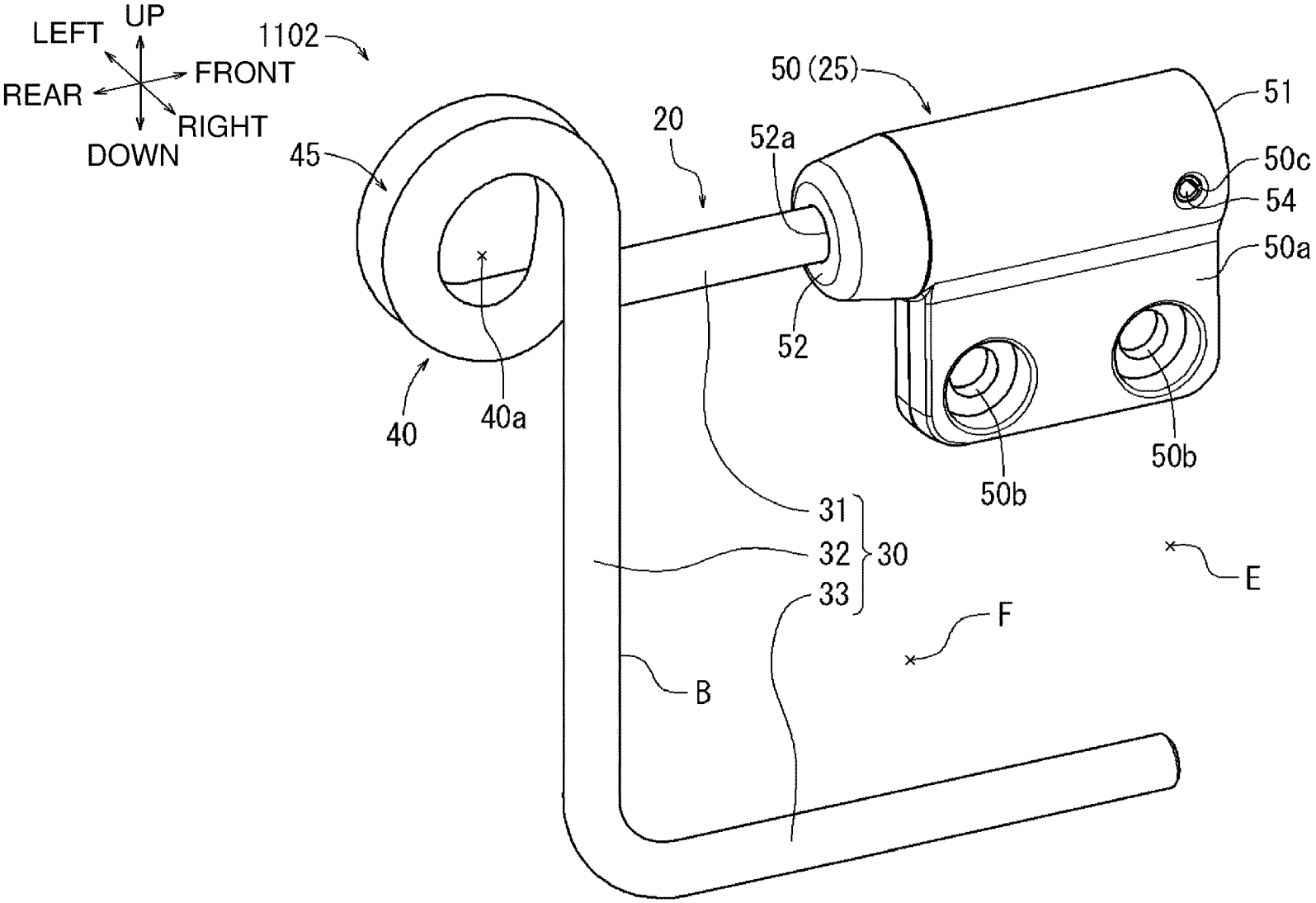
FIG. 22 is a perspective view of a tool holder according to a twelfth embodiment.

In the first embodiment, the intermediate portion 32 and the overlapping portion 41 overlap into the overlap 45 (double wound portion). However, the overlap 45 may have at least two turns, or for example, three or four turns, formed from the intermediate portion 32 and the overlapping portion 41. The same applies to all the corresponding embodiments (sixth to ninth embodiments). For example, as in a tool holder 1102 according to a twelfth embodiment in FIG. 22, the annular portion 40 of the tool holder 702 according to the eighth embodiment may overlap into the overlap 45 (double wound portion).

Figure 23:
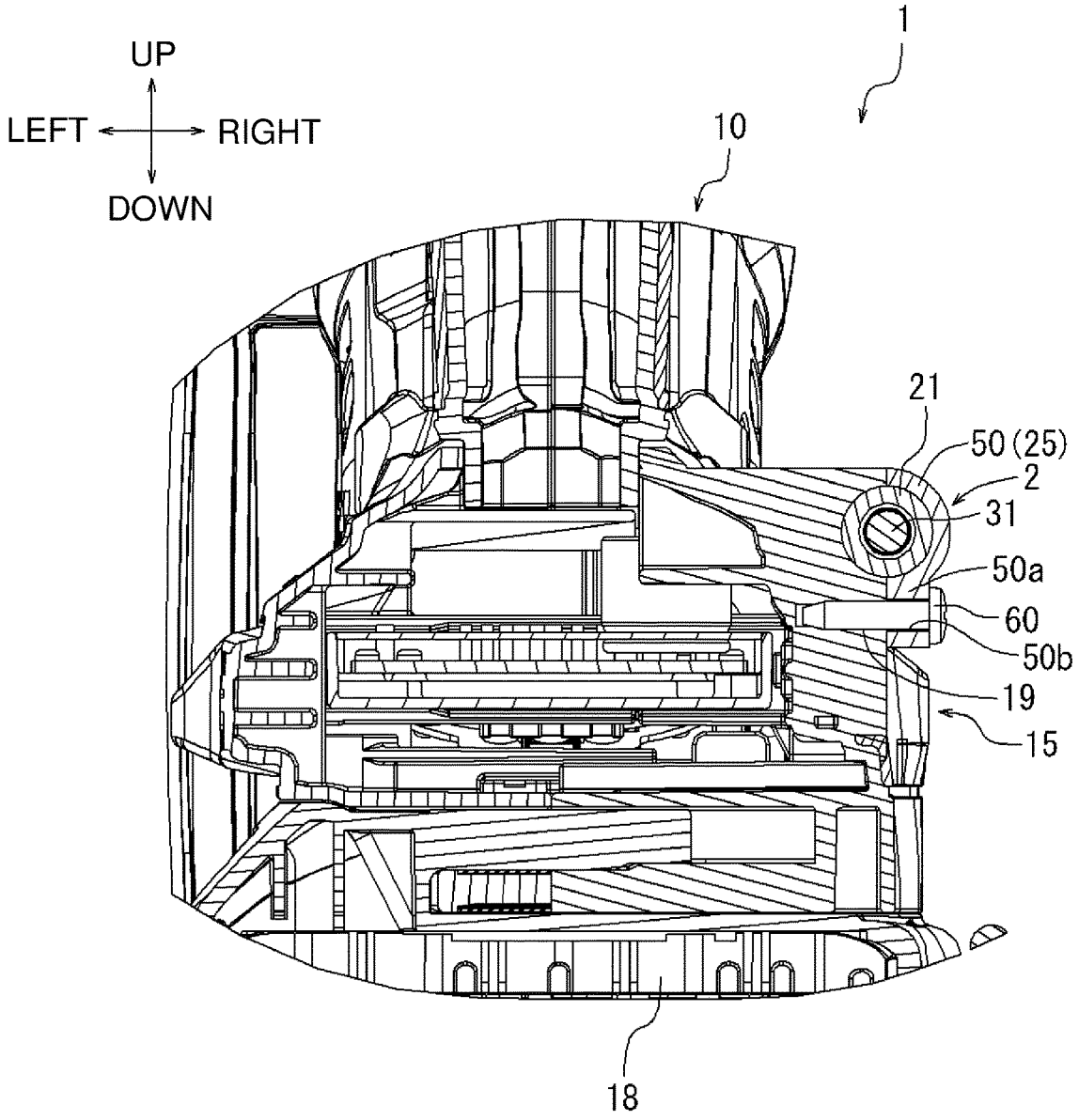
FIG. 23 is a cross-sectional view of a battery mount of a power tool and a base of a tool holder according to a modification of the first embodiment.
Figure 24:
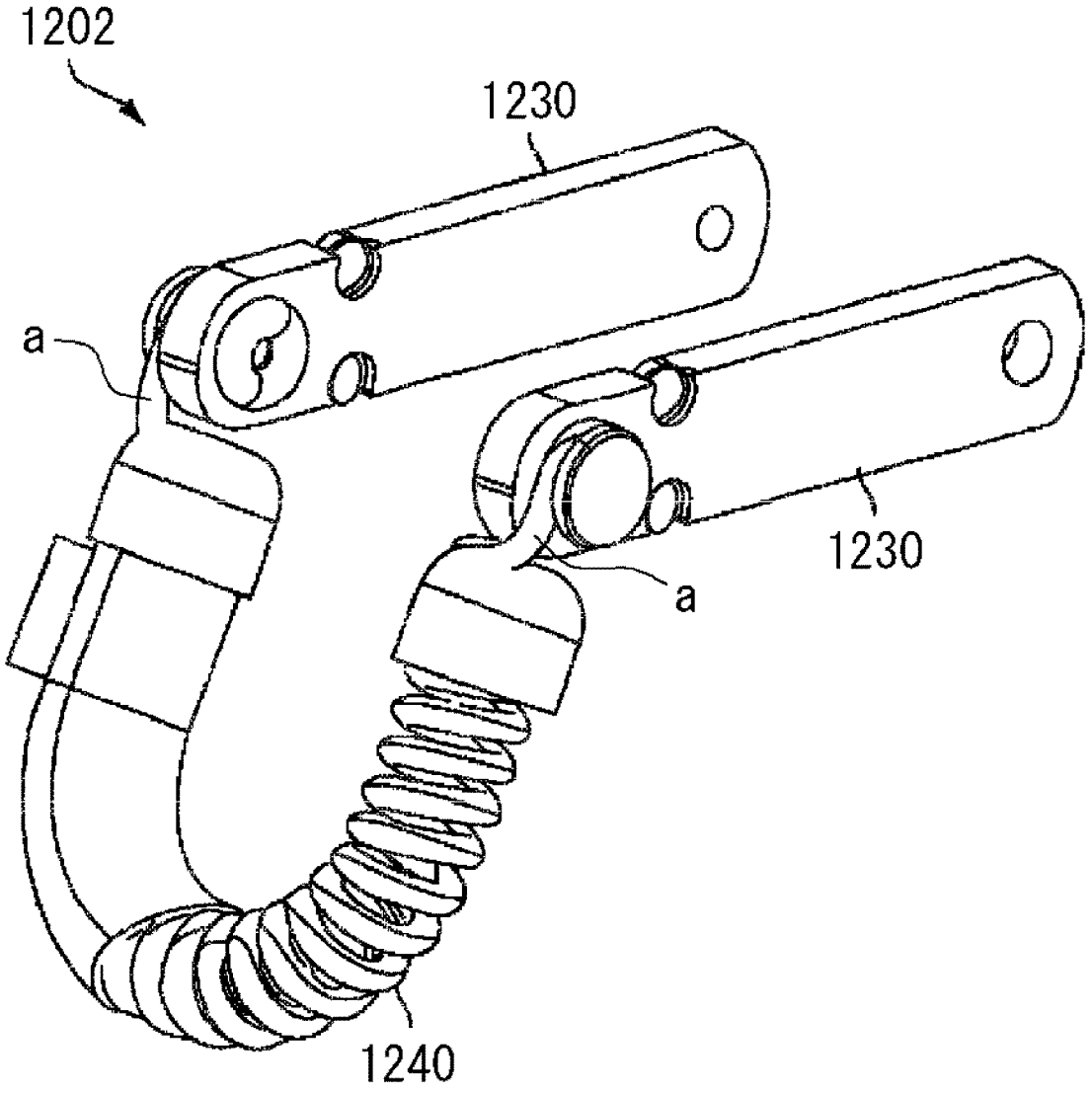
FIG. 24 is an overall perspective view of a strap according to a known technique.

As shown in FIG. 23, unlike the base 50 according to the first embodiment, the base 50 of the tool holder 2 may be a substantially semicircular member. The remaining substantially semicircular portion is thus formed on the battery mount 15. This structure can simplify the shape of the tool holder 2. The same applies to the second to twelfth embodiments.

In the fourth embodiment, the annular portion 40 is fixed to the intermediate portion 32 of the hook portion 30. The annular portion 40 may instead be axially slidable over the intermediate portion 32 of the hook portion 30 or rotatable about the axis.

In each embodiment, a hammer drill is an example of the power tool 1. The tool holder described above is instead widely usable for other hand-held power tools including a drilling tool, a screwdriver, a grinder, or a cutting machine.

REFERENCE SIGNS LIST

1 power tool (electric tool, power tool)
2 tool holder (first embodiment)
3 suspension member
3*a* carabiner
3*b* cord
4 hook support
5 suspension support
10 body housing
11 motor housing
12 handle
14 hand grip
15 battery mount
16 drill bit
17 trigger
18 battery pack
19 screw hole
20 holder body
21 elastic piece
21*a* through-hole
22 compression spring
23 spring stopper
23*a* first insertion hole
23*b* second insertion hole
23*c* basal end wall
23*d* first notch groove
23*e* second notch groove
23*f* flat portion
24 first spring pin
25 shock-absorbing mechanism
30 hook portion (hook)
31 shaft
31*a* insertion hole
31*b* basal end
32 intermediate portion
33 distal end
40 annular portion
40*a* through-hole
40*b* metal coupler
41 overlapping portion
42 opposing portion
43 second bend
44 third bend
45 overlap
E opening
B hook bottom
F hook area
50 base
50*a* mount flange
50*b* insertion hole
50*c* pin insertion hole
51 opening
52 wall
52*a* through-hole
53 internal space
54 second spring pin
60 mount screw
70 first bend (bend)
71 fourth bend (bend)
102 tool holder (second embodiment)
202 tool holder (third embodiment)
302 tool holder (fourth embodiment)
402 tool holder (fifth embodiment)
502 tool holder (sixth embodiment)
602 tool holder (seventh embodiment)
702 tool holder (eighth embodiment)
802 tool holder (ninth embodiment)
902 tool holder (tenth embodiment)
1002 tool holder (eleventh embodiment)
1102 tool holder (twelfth embodiment)
1202 strap
1230 holder
1240 tension spring
D diameter
L1 hooking depth (first embodiment)
L2 hooking depth (second embodiment)
R1 radius (first embodiment)
R2 radius (second embodiment)
R3 radius (third embodiment)
R5 radius (fifth embodiment)
X axis
Y center of gravity
a coupler
S point of shock application

What is claimed is:

1. A power tool, comprising:
a housing; and
a tool holder attachable to the housing and including
a hook portion (i) configured to hook the power tool on a support separate from the power tool and (ii) including
a shaft having a first straight portion and a first free end of the hook portion,
a distal end having a second straight portion and a second free end of the hook portion, and
an intermediate portion between and connecting the shaft and the distal end, and
a base supporting the hook portion, wherein:
the intermediate portion includes an annular portion configured to receive a suspension member through the annular portion; and
the first free end and the second free end are spaced and configured such that the support is received through an opening defined by and between the first free end and the second free end when the power tool is hooked on the support and removed from the support.

2. The power tool according to claim 1, wherein
the base is removably attached to the power tool.

3. The power tool according to claim 1, wherein
the base has a substantially semicircular cross section, and
the power tool includes a battery mount having a substantially semicircular cross section to receive the base.

4. The power tool according to claim 1, wherein
the hook portion includes a hook area defined by an opening to receive the support and a hook bottom to come in contact with the support, and the hook area is configured such that the support is in the hook area when the power tool is hooked on the support.

5. The power tool according to claim 1, wherein
the tool holder is configured such that, when the power tool falls and strikes another object, the annular portion receives shock through the suspension member at a position farthest from the base.

6. The power tool according to claim 1, wherein
the annular portion includes an overlapping part at which sections of the annular portion overlap and abut, and
the tool holder is configured such that, when the power tool falls and strikes another object, the annular portion receives shock through the suspension member at the overlapping part.

7. The power tool according to claim 4, wherein
the annular portion is in the hook area.

8. The power tool according to claim 4, wherein
a part of the annular portion nearer the base includes an entire part of the hook bottom.

9. The power tool according to claim 8, wherein
the part of the annular portion nearer the base is substantially straight.

10. The power tool according to claim 4, wherein
the annular portion is circular and has a diameter substantially equal to a width of the opening.

11. The power tool according to claim 1, wherein
the tool holder includes, between the base and the annular portion, a shock-absorbing mechanism configured to move the annular portion relative to the power tool.

12. The power tool according to claim 4, wherein
the annular portion and the hook portion include a bent single wire.

13. The power tool according to claim 2, wherein
the hook portion includes a hook area defined by an opening to receive the support and a hook bottom to come in contact with the support, and the hook area is configured such that the support is in the hook area when the power tool is hooked on the support.

14. The power tool according to claim 3, wherein
the hook portion includes a hook area defined by an opening to receive the support and a hook bottom to come in contact with the support, and the hook area is configured such that the support is in the hook area when the power tool is hooked on the hook support.

15. The power tool according to claim 2, wherein
the tool holder is configured such that, when the power tool falls and strikes another object, the annular portion receives shock through the suspension member at a position farthest from the base.

16. The power tool according to claim 3, wherein
the tool holder is configured such that, when the power tool falls and strikes another object, the annular portion receives shock through the suspension member at a position farthest from the base.

17. The power tool according to claim 4, wherein
the tool holder is configured such that, when the power tool falls and strikes another object, the annular portion receives shock through the suspension member at a position farthest from the base.

18. The power tool according to claim 2, wherein
the annular portion includes an overlapping part at which sections of the annular portion overlap and abut, and
the tool holder is configured such that, when the power tool falls and strikes another object, the annular portion receives shock through the suspension member at the overlapping part.

19. The power tool according to claim 11, wherein the shock-absorbing mechanism is housed in the base and includes an elastic member configured to absorb shock.

20. The power tool according to claim 1, wherein:
the annular portion includes an overlapping part in which sections of the annular portion overlap and abut and a parallel portion that is spaced from and substantially parallel to the overlapping part; and
the annular portion is configured such that the support is received and contained between the overlapping part and the parallel portion.

* * * * *